US006683043B1

(12) United States Patent
Dovey et al.

(10) Patent No.: US 6,683,043 B1
(45) Date of Patent: Jan. 27, 2004

(54) PROCESS FOR MANUFACTURING EFFERVESCENCE COMPONENTS

(75) Inventors: Anthony Dovey, Swarland (GB); Peter Gerard Gray, Killingworth (GB); Gail Margaret Baston, Whitley Bay (GB); Zoe Dyter, Gosforth (GB); Christopher Charles Driffield, High Heaton (GB); David William York, Ponteland (GB)

(73) Assignee: The Procter & Gamble Company, Cincinnati, OH (US)

( * ) Notice: Subject to any disclaimer, the term of this patent is extended or adjusted under 35 U.S.C. 154(b) by 0 days.

(21) Appl. No.: 09/856,592

(22) PCT Filed: Dec. 1, 1999

(86) PCT No.: PCT/US99/28420

§ 371 (c)(1),
(2), (4) Date: Aug. 24, 2001

(87) PCT Pub. No.: WO00/34422

PCT Pub. Date: Jun. 15, 2000

(30) Foreign Application Priority Data

Dec. 8, 1998 (GB) ..... 9826841

(51) Int. Cl.[7] ..... C11D 11/00

(52) U.S. Cl. ..... 510/444; 510/446; 510/509; 510/513; 510/533

(58) Field of Search ..... 510/445, 276, 510/349, 446, 441, 444, 478, 488, 495, 533, 509, 513; 424/43, 44

(56) References Cited

U.S. PATENT DOCUMENTS

| | | | | | |
|---|---|---|---|---|---|
| 4,093,710 | A | * | 6/1978 | Sass et al. | 424/44 |
| 4,155,868 | A | * | 5/1979 | Kaplan et al. | 510/117 |
| 4,473,485 | A | * | 9/1984 | Greene | 510/356 |
| 4,650,669 | A | * | 3/1987 | Alexander et al. | 424/44 |
| 4,678,661 | A | * | 7/1987 | Gergely et al. | 424/44 |
| 5,064,656 | A | * | 11/1991 | Gergely et al. | 424/463 |
| 5,232,701 | A | * | 8/1993 | Ogawa et al. | 424/408 |
| 5,260,304 | A | * | 11/1993 | Gergely et al. | 514/58 |
| 5,854,189 | A | * | 12/1998 | Kruse et al. | 510/224 |
| 6,080,711 | A | * | 6/2000 | Brouwer et al. | 510/324 |

FOREIGN PATENT DOCUMENTS

| | | | |
|---|---|---|---|
| DE | 34 47 423 | A1 | 7/1986 |
| EP | 0 203 768 | A2 | 12/1986 |
| EP | 0 333 223 | A2 | 9/1989 |
| EP | 0 534 525 | A2 | 3/1993 |
| JP | 07187998 | A2 * | 7/1995 |
| WO | WO 98/04662 | | 2/1998 |
| WO | WO 98/46714 | | 10/1998 |
| WO | WO 98/46716 | | 10/1998 |

* cited by examiner

*Primary Examiner*—Lorna M. Douyon
(74) *Attorney, Agent, or Firm*—Julia A. Glazer; Brahm J. Corstanje; Kim W. Zerby

(57) ABSTRACT

A process for manufacturing effervescence component comprises grinding a coarse acid source to obtain an acid source whereof at least 75% has a particle size from 0.1 to 150 microns, mixing the ground acid source and the carbon dioxide source and optionally the binder and/or other actives to form a mixture, and submitting the mixture to a granulation step, preferably comprising a compaction step and/or an agglomeration step.

1 Claim, No Drawings

PROCESS FOR MANUFACTURING EFFERVESCENCE COMPONENTS

TECHNICAL FIELD

The present invention is applicable to compositions which need to be dissolved in an aqueous medium in an easy and fast way. This technology may found application in various fields, e.g., in detergent compositions like laundry detergent compositions, soaking detergent compositions, dish washing compositions or any other compositions for household applications, in pharmaceutical preparations, dental preparations, food and the like. More particularly, the present invention relates to granular detergent compositions intended for the cleaning of fabrics.

BACKGROUND OF THE INVENTION

A problem associated to conventional granular compositions which are to be used by the consumer after having been diluted typically with water, is their tendency towards poor dissolution or poor dispensing. That tendency has been exacerbated by the recent trend in for example the detergent industry towards higher bulk density granular compositions and towards granular detergent compositions which have a higher content of active ingredients. Granular detergent compositions of high bulk densities ranging from 650 to 1100 kg/m3 are attractive to consumers but not satisfactorily dissolved into an aqueous medium.

Another difficulty with detergent compositions is that they are not easily flushed from the dispenser drawer of a washing machine. Similar problems are encountered when using such granular detergent compositions in a dosing device in the washing drum.

It is known to use citric acid and carbonate in powder compositions to promote dissolution of for example pharmaceutical preparations and detergents by effervescence.

An issue with such compositions containing particulate acid and carbonate can be the poor storage stability when they are exposed to moisture, leading to a reduced effervescence. Therefore, it is suggested in for example EP 534525-A, to use large particle size citric acid, which is said to be stable when exposed to moisture.

However, the inventors have now surprisingly found that very small particle size acid materials provide improved effervescence. Surprisingly, they found that the small particle size acid can be used in compositions without incurring stability problems of the effervescence system, in contrast to the teaching of the prior art, whilst providing more efficient and rapid effervescence. They have found that the incorporation of very small particle size acid sources results not only in an improved dispensing/dissolution compared to larger particle size acids, but also in an improved, more rapid sudsing, which may be highly advantages in certain applications. An further improved effervescence performance and more efficient dispensing and/or dissolution and/or sudsing is achieved when the carbon dioxide source is also of a small particle size.

Highly preferred may be that the acid and the carbon dioxide source are in an intimate mixture, preferably in the form of a dry effervescence granule. This not only further improves the stability of the effervescence system, but can also increase the effervescence efficiency, thus resulting in smaller amounts of acid source needed for the desired effervescence, dispensing/dissolution and/or sudsing. Furthermore, the inventors have found that can be advantageous that the effervescence granule is of a large particle size, to obtain a more stable, better effervescing granule.

The inventors have surprisingly found that when small particle size acid sources are used, a stronger and more homogeneous particle can be obtained, thus improving the effervescence performance Furthermore, when a compacted effervescence granule is required, the compaction pressure can be reduced when the small particle size acid source, and optionally small particle size carbon dioxide source, is employed. Such a granule dissolves more rapidly and provides thus an improved effervescing. Additionally, or alternatively, when the granule is made by agglomeration, it has been found to be beneficial that small particle size acids are used; in particular when a binder is used to form the agglomerates the performance characteristics of the effervescence agglomerate have been found to be less effected by the binder when small acid material is incorporated than when larger particle size material is used.

Furthermore, the inventors have found that when a coating comprising a specific alkoxylated alcohol is present on the effervescence component, or one or more ingredients thereof, this not only increases the stability of the effervescence component when exposed to moisture, but also suprisingly enhances the production of long lasting suds of high volume.

The enhanced production of long lasting suds of high volume by the coated effervescence component also has the added benefit of giving a clear signal to the user that the detergent composition comprising the coated effervesence component has dissolved and is now, or is ready to start, cleaning soiled articles. This is especially applicable in hand washing applications when the introduction of soiled articles into the washing cycle may not be optimal until the detergent composition has dissolved.

Also, the selected alkoxylated alcohol mentioned above may act as a suds suppresser during later stages of the washing cycle, such as during rinsing, and hence possess a dual role in the washing cycle. The specific alkoxylated alcohol, by acting in this dual manner, has a good impact on formulation space, allowing more room for other optional detergent components, since it helps to negate the need for two separate detergent composition constituents for suds production and suppression.

SUMMARY OF THE INVENTION

The present invention provides an effervescence component comprising an acid source and a carbon dioxide source, wherein at least 75% of said acid source has a particle size from 0.1 to 150 microns, more preferably from 0.5 to 100 microns.

In one embodiment, it is highly preferred that the carbon dioxide source has a volume median particle size from 5 to 375 microns, whereby preferably at least 60% has a particle size of from 1 to 425 microns, or even preferably a volume median particle size from 10 to 250 microns, whereby preferably at least 60% has a particle size of from 1 to 375 microns. In one preferred embodiment the carbon dioxide source has a particle size similar to the acid source, preferably such that at least 60% or even 75% of the carbon dioxide source has a particle size from 1 to 150 microns, more preferably from 1 to 100 microns.

In a highly preferred embodiment, the acid source and the carbon dioxide source are present in an intimate mixture with one another, preferably in a granule.

The invention also provides a process for manufacturing such a granule comprises the steps of:

mixing the acid source and the carbon dioxide source and optionally a binder to form an mixture, then submitting the mixture to a granulation step, preferably comprising an compaction and/or agglomeration step to form a compacted and/or agglomerated mixture.

Preferably the acid source is a particulate material which is first ground to obtain the acid source of the invention, prior to mixing with the carbon dioxide source. The carbon dioxide source may also be obtained by grinding larger particle size material.

The present invention also encompasses compositions containing the effervescence component. In a preferred embodiment, the compositions are solid or non-aqueous detergent compositions, including laundry, pre-treatment and dish washing compositions, preferably solid compositions in the from of granules, tablet or bar.

Additionally, the present invention also encompasses detergent compositions comprising a coated effervescence component, where the coating comprises an alkoxylated alcohol having an alkoxylation degree of at least 20.

DETAILED DESCRIPTION OF THE INVENTION

Acid Source

Suitable acid sources herein are capable of providing solid organic, mineral or inorganic acids, and the sources are thereto preferably in the form of acids, salts or derivatives thereof or a mixture thereof. Derivatives in particular include ester of the acids.

In particular organic acids are preferred. It may be preferred that the acids are mono-, bi- or tri-protonic acids. Such preferred acids include mono- or polycarboxylic acids preferably citric acid, adipic acid, glutaric acid, 3 cetoglutaric acid, citramalic acid, tartaric acid, maleic acid, fumaric acid, malic acid, succinic acid, malonic acid. Such acids are preferably used in their acidic forms, and it may be preferred that their anhydrous forms are used, or mixtures thereof. Preferred acid sources are malic acid anhydrate and maleic acid anhydrate. Other preferred acids include sulphonic acids such as toluenesulphonic acid.

Surprisingly, it has now been found that by using citric acid, tartaric acid, maleic acid and/or malic acid, an improved physical and/or chemical stability upon prolonged storage periods is achieved. Furthermore, it has been found that these materials, in particular tartaric acid have an improved dissolution, resulting in an improved effervescence performance.

The acid source and preferably the acid itself is a particulate compound whereof at least 75%, preferably at least 85% or even at least 90% or even at least 95% or even at least 99% by volume, has a particle size from 0.1 to 150 microns and more preferably from 0.5 to 100 microns and it may even be preferred that at least 65% or even at least 75% or even at least 85% has a particle size from 1.0 to 75 microns or even from 1.0 to 55 microns or even form 1.0 to 25 microns.

The particle size of the acid source and the carbon dioxide source herein after, can be determined by any method known in the art, in particular by laser light scattering or deftraction technique, such as with Malvem 2600 or Sympatec Helos laser light scattering equipment (or defractometer).

It may herein be preferred that the acid source has a volume median particle size of between 1 to 120 microns or even between 5 to 75 microns or even between 5 to 55 microns or even from 5 to 30 microns.

The volume median particle size of the acid source and the carbon dioxide source can be determined by any method known in the art, in particular herein by use of the laser light scattering equipment mentioned herein, which is programmed to provide the volume median particle size.

The acid source herein is preferably obtained by grinding or milling coarse acid source material, having a larger particle size than the acid source herein, just prior to incorporation into the effervescence component. Namely, it has been found that handling of the fine particle size acid sources herein after storage may incur problems, and therefor it may be advantages to store the acid source in a coarser form and ground this material prior to use.

Carbon Dioxide Source

Another essential feature of the present invention is a carbon dioxide source. When used herein, carbon dioxide source includes any material which can provide carbon dioxide when reacting with an acid source upon contact with water. This source in particular includes carbonate, bicarbonate and percarbonate salts or mixtures thereof, in particular bicarbonate and/or carbonate. Suitable carbonates to be used herein include carbonate and hydrogen carbonate of potassium, lithium, sodium, and the like amongst which sodium and potassium carbonate are preferred. Suitable bicarbonates to be used herein include any alkali metal salt of bicarbonate like lithium, sodium, potassium and the like, amongst which sodium and potassium bicarbonate are preferred. Bicarbonate may be preferred to be used in combination with or alternative to carbonate, because it is more weight effective. However, the choice of carbonate or bicarbonate or mixtures thereof in the dry effervescent granules may be made depending on the pH desired in the aqueous medium wherein the dry effervescent granules are dissolved. For example where a relative high pH is desired in the aqueous medium (e.g., above pH 9.5) it may be preferred to use carbonate alone or to use a combination of carbonate and bicarbonate wherein the level of carbonate is higher than the level of bicarbonate, typically in a weight ratio of carbonate to bicarbonate from 0.1 to 10, more preferably from 1 to 5 and most preferably from 1 to 2.

The carbon dioxide source has preferably a volume median particle size from 5 to 375 microns, whereby preferably at least 60%, preferably at least 70% or even at least 80% or even at least 90% by volume, has a particle size of from 1 to 425 microns. More preferably, the carbon dioxide source has a volume median particle size of 10 to 250, whereby preferably at least 60%, or even at least 70% or even at least 80% or even at least 90% by volume, has a particle size of from 1 to 375 microns; or even preferably a volume median particle size from 10 to 200 microns, whereby preferably at least 60%, preferably at least 70% or even at least 80% or even at least 90% by volume, has a particle size of from 1 to 250 microns.

In one preferred embodiment the carbon dioxide source has a particle size similar to the acid source, preferably such that at least 60% or even 75% of the carbon dioxide source has a particle size from 1 to 150 microns, whereby preferably the source has a volume median particle size of between 1 to 120 microns, but more preferably at least 60% or even 75% of the source having a particle size from 1 to 100 microns, having a volume median particle size of from 5 to 75, or even preferably at least 60% or even 75% of the source having a particle size of from 1.0 to 75 microns or even from 1.0 to 55 microns or even form 1.0 to 25 microns.

It may be preferred that the carbon dioxide source of the required particle size is obtained by grinding a larger particle size material, optionally followed by selecting the material with the required particle size by any suitable method.

Intimate Effervescence Mixture/effervescent Granule and Process for its Manufacturing The acid source and carbon dioxide source, or at least part thereof are preferably present in an intimate mixture with one another, which means for the purpose of the invention that the acid source and carbon dioxide source are homogeneously mixed. Thus, in one highly preferred embodiment, at least part of the acid source and at least part of the carbon dioxide source are not separate discrete particles. Highly preferred is that the acid source and the carbon dioxide source are present in an effervescence granule, preferably being a dry effervescence granule.

The acid is preferably present in the intimate mixture or the effervescent granules at a level of from 0.1% to 99% by weight of the total granule, preferably from 3% to 75%, more preferably from 5% to 60% and most preferably from 15% to 50%.

The carbon dioxide source is preferably present in the intimate mixture or the effervescent granules at a level of from 0.1% to 99% by weight of the total, preferably from 30% to 95%, more preferably from 45% to 85% and most preferably from 50% to 80%.

By "dry" it is to be understood that the granule is substantially free of water, i.e., that no water has been added or present other than the moisture of the raw materials themselves. Typically, the level of water is below 5% by weight of the total intimate mixture or granule, preferably below 3% and more preferably below 1.5%.

It may be preferred that a desiccant is present in the intimate mixture or the effervescence granule, such as overdried inorganic and organic salts, anhydrous salts, in particular overdried silicates and aluminosilicates, anhydrous silicates and/or sulphate salts.

For optimum effervescence in aqueous medium the weight ratio of acid source to carbon dioxide source in the intimate mixture or the effervescent granule is preferably from 0.1 to 10, preferably from 0.5 to 2.5 and more preferably from 1 to 2.

The effervescent granules are preferably obtainable by a process comprising a granulation step, preferably comprising the step of dry-powder compaction or pressure agglomeration. While all binding mechanisms can occur in pressure agglomeration, adhesion forces between the solid particles, i.e., between the acid, carbon dioxide source and optionally the binder if present, play an especially important role. This is because pressure agglomeration, especially high pressure agglomeration, is an essentially dry process that forms new entities (i.e., dry effervescent granules) from solid particles (i.e., the acid, bicarbonate, carbonate source and optionally the binder) by applying external forces to density a more or less defined bulk mass or volume and create binding mechanisms between the solid particles providing strength to the new entity, i.e. the high external force applied brings the solid particles closely together. The inventors have surprisingly found that in the present invention reduced pressure may be sufficient to form a stable granule incorporating the small particle size acid source, with preferably small particle size carbon dioxide source as defined above.

The effervescent granules may have any particle size, the preferred particle size depending on the application and the component of the granule.

In one preferred embodiment, the effervescence granule has a weight average particle size from 500 microns to 1500 microns whereby preferably at least 70% or even at least 80% by weight of said granule has a particle size from 350 to 2000 microns, or even having a weight average particle size from 650 microns to 1180 microns whereby preferably at least 70% or even 80% by weight of said granule has a particle size from 500 to 1500 microns, or even having a weight average particle size from 710 microns to 1000 microns whereby preferably at least 70% or even 80% by weight of said granule has a particle size from 600 to 1180 microns. It has been found that effervescence particles of these particle size parameters, comprising the acid source as defined herein, not only can provide improved dispensing/dissolution but also can provide an improved sudsing, including more rapid sudsing, and/or improved foam.

In another preferred embodiment, the effervescence granule has preferably a weight average particle size from 200 microns to 500 microns whereby preferably at least 70% of said granule has a particle size from 100 to 710 microns, or even having a weight average particle size from 250 microns to 450 microns whereby preferably at least 70% of said granule has a particle size from 150 to 650 microns. It has been found that effervescence particles of these particle size parameters, comprising the acid source as defined herein, can provide better dispensing and/or dissolution of the detergent composition than larger effervescence particles, mentioned above.

The weight average particle size of the effervescence granule herein and the detergent granules herein after can be determined by any method known in the art, in particular by sieving a sample of the particulate acid relevant material herein through a series of sieves, typically 5, with meshes of various diameter or aperture size, obtaining a number of fraction (thus having a particle size of above, below or between the mesh sizes of the used sieve sizes), whereof the weight is determined (weight fractions). The average particle size per fraction and then the weight average particle size of the material can be calculated, taking in account the weight percentage per fraction (e.g. plotting the weight fractions against the aperture size of the sieves).

The intimate mixture or the effervescent granules may optionally comprise a binder or a mixture of binders. Any binder material known in the art can be used. For example highly suitable are materials which have a melting point above 40 C, put preferably below 200 C or 100 C. In general, suitable binders to use herein are those known to those skilled in the art and include anionic surfactants like C6–C20 alkyl or alkylaryl sulphonates or sulphates, preferably C8–C20 aklylbenzene sulphonates, fatty acids, cellulose derivatives such as carboxymethylcellulose and homo- or co-polymeric polycarboxylic acid or their salts, nonionic surfactants, preferably C10–C20 alcohol ethoxylates containing from 5–100 moles of ethylene oxide per mole of alcohol and more preferably the C15–C20 primary alcohol ethoxylates containing from 20–100 moles of ethylene oxide per mole of alcohol. Of these tallow alcohol ethoxylated with 25 moles of ethylene oxide per mole of alcohol (TAE25) or 50 moles of ethylene oxide per mole of alcohol (TAE50) are preferred. Other preferred binders include the polymeric materials like polyvinylpyrrolidones with an average molecular weight of from 12 000 to 700 000 and polyethylene glycols with an average weight of from 600 to 10 000. Copolymers of maleic anhydride with ethylene, methylvinyl ether, methacrylic acid or acrylic acid are other examples of polymeric binders. Others binders further include C10–C20 mono and diglycerol ethers as well as C10–C20 fatty acids.

It may be preferred that the effervescence granule comprises a coating agent, which can be selected from any coating agent known in the art. Preferred coating agents are materials which can be applied to the granule in the form of a melt, which is solid under ambient conditions, such as polymeric materials, nonionic surfactants. These materials may be also used as binding agents, described herein. Also preferred may be coating agent which can be applied to the granule in the form of an aqueous solution or a solution in an organic solvent, including organic and inorganic acids or salts. Furthermore, the granules may also be coated by dusting a particulate material onto the granule, for example desiccants as described herein.

It may be preferred that the intimate mixture or the granule comprises other ingredients, such as detergent actives when employed in detergent compositions. Preferred are surfactants (which may also act as binder and/or coating agents), bleaching components in particular bleach activators or precursors, catalyst or perhydrogen salts, perfumes, brightners, builders, enzymes.

Typically, they comprise up to 70% by weight of the total granule or mixture of one or more binders and/or other actives, preferably up to 50% and more preferably up to 35%.

The present invention further encompasses a process for manufacturing the effervescent granules of the present invention comprising an acid, carbon dioxide source and optionally a binder, wherein the acid, carbon dioxide source and optionally the binder are in an intimate mixture This process preferably comprises the steps of:

first obtaining the acid source of the particle size defined herein, preferably by grinding larger particle size acid source material as commercially available, mixing the thus obtained acid source with the carbon dioxide source, preferably by grinding larger particle size acid source material as commercially available, and optionally mixing a binder and/or other ingredients, to form a mixture, then submitting the mixture to a granulation step, preferably comprising the step of extrusion, spheronisation, more preferably compaction or agglomeration.

Optionally, other ingredients can be added to the obtained granule, such as coating agents, which will be discussed in more detail later.

By "granulation step" it is meant that the resulting mixture is made into granules of the required size as defined herein before.

A preferred process to be used herein is roller compaction. In this process the acid and carbon dioxide sources and optionally the binder and other ingredients, after having been mixed together, are forced between two compaction rolls that applies a pressure to said mixture so that the rotation of the rolls transforms the mixture into a compacted sheet/flake. This compacted sheet/flake is then granulated. One way to carry this out is to mill the compacted flake/sheet or to granulate the agglomerate mixture by conventional means. Milling may typically be carried out with a Flake Crusher FC 200® commercially available from Hosokawa Bepex GmbH. Depending on the end particle size desired for the effervescent granules the milled material may further be sieved. Such a sieving of the dry effervescent granules can for example be carried out with a commercially available Alpine Airjet Screen®.

According to this process the effervescent raw materials and optionally the binder if present are preferably mixed together without the addition of water and/or moisture apart those coming from the raw materials themselves so as to obtain a dry free flowing powder mixture. Then this dry free flowing powder mixture comprising the effervescent particles (i.e. the acid and carbon dioxide source), and optionally the binder particles if present, undergoes a granulation step, preferably including a pressure agglomeration step, i.e. a dry process step wherein this free flowing powder mixture undergoes high external forces that bring the particles closely together thereby densifying the bulk mass of said particles and creating binding mechanisms between the solid effervescent particles and the binder if present.

Typical roller compactors for use herein is for example Pharmapaktor L200/50P® commercially available from Hosokawa Bepex GmbH. The process variables during the pressure agglomeration step via roller compaction are the distance between the rolls, the feed rate, the compaction pressure and the roll speed. Typical feeding device is a feed screw. The distance between the rolls is typically from 0.5 cm to 10 cm, preferably from 3 to 7 cm, more preferably from 4 to 6 cm. The pressing force is typically between 20 kN and 120 kN, preferably from 30 kN to 100 kN, more preferably from 40 kN to 80 kN, altough lower pressures are possible and may be preferred in the present invention employing file particle size acid sources. Typically, the roll speed is between 1 rpm and 180 rpm, preferably from 2 rpm to 50 rpm and more preferably from 2 rpm to 35 rpm. Typically, the feed rate is between 1 rpm and 100 rpm, preferably from 5 rpm to 70 rpm, more preferably from 8 rpm to 50 rpm. Temperature at which compaction is carried out is not relevant, typically it varies from 0° C. to 40° C.

It may be preferred that the granules are made under dry-air, having a humidity of below 30%.

Coating of the Effervescence Component

It may be preferred that the effervescence component is coated by any coating agent known in the art, or a mixture thereof. Preferably the coating comprises a surfactant and any other optional detergent ingredient. Usually, the surfactant forms at least 20% by weight of the coating, preferably >75%, more preferably >95% and even more preferably 100%.

The surfactant can be any surfactant known in the art, preferably an alkoxylated alcohol, more preferably an alkoxylated alcohol with an average alkoxylation degree of at least 20, more preferably at least 40, even more preferably from 50 to 80. The alkoxylated alcohol usually has a melting point of at least 40° C., preferably at least 50° C., more preferably from 60° C. to 70° C. Preferably, the alkoxy groups are ethoxygroups.

The alkoxylated alcohol is derived from an alkoxylated alcohol comprising a hydrocarbon group comprising preferably 12 to 18 carbon atoms, preferably comprising a hydrocarbon chain of a length from 12 to 18 carbon atoms. The hydrocarbon chain may be linear or branched and includes all derivative forms attainable by 12 to 18 carbon atoms in any conformation.

The coating is applied to the effervescence component by any process known in the art, preferably by spraying a melted form of the coating comprising the alkoxylated alcohol onto the effervescence component. This involves melting the coating comprising the alkoxylated alcohol usually at a temperature of at least 40° C., preferably at least 50° C., more preferably from 60° C. to 70° C. The spraying process can be any known in the art, preferably by a hotmelt spraygun that sprays the coating into a rotating mixer containing the core, or by a fluid bed countercurrent spray or a wurster-type cocurrent coater, both of which spray the coating onto a fluidised bed containing the effervescence component.

The effervescence component obtainable by the above process(es) comprises the coating on the surface, preferably in such a way so that the coating encloses the effervescence component although the coating can also partially enclose the effervescence component. The coating can also totally or partially enclose any ingredient of the effervescence component, namely the acid source and/or the carbon dioxide source.

Preferably, he coating is contacted with the effervescence component by any process known in the art. Usually to form an intimate mixture, preferably in much a way so that the coating either partially or totally encloses the effervescence component. The coating being from 0.5% to 25% by total weight of the effervescence component, preferably from 2% to 10%.

The coated effervescence component can be obtained by any process involving the mixing of the ingredients, which can be part of a compression or tableting process, extrusion process and agglomeration processes. Preferably, the coated effervescence component is prepared by a process whereby a melt of one ingredient is admixed to another ingredient whereby simultaneously or subsequently solid particles are formed, preferably by subsequently solidifying the melt, preferably by reducing the process temperature. When more than one ingredient is to be incorporated in the coated effervescence component the melt is preferably admixed to a premix of ingredients, which are premixed prior to admixing the melt, to obtain an intimate mixture of the ingredients prior to addition of the melt. The ingredients mentioned above being a specific alkoxylated alcohol, an acid source, a carbon dioxide source, any other optional detergent ingredient, or any combination thereof.

The effervescence component along with any optional detergent ingredients can form part of a detergent composition for the application of automated and/or hand washing applications.

In particular, the coated effervescence component comprising the specific alkoxylated alcohol can act to produce suds during the dispensing stage of the washing cycle and can also act as a suds suppresser during later stages of the washing cycle. Later stages of the washing cycle being at least 5 minutes after the dispensing stage.

Detergent Compositions

In a preferred embodiment the effervescent component or effervescence granules herein are comprised in a compositions which require dispensing and dissolution in water, in particular in a shorter period of time and/or in cold water and/or at lower total level of effervescent particles/materials.

The effervescence component is preferably present at a level such that the acid source is present at a level of from 0.5% to 40% by weight of the detergent component, more preferably of from 1% to 30% or even from 2% to 25% or even from 4% to 20% by weight; and such that the carbon dioxide source is preferably present at a level of from 1% to 60% by weight of the detergent composition, more preferably of from 2% to 50% or even from 4% to 35% or even from 6% to 30% by weight.

In particular the effervescence components herein are incorporated in cleaning compositions such as laundry detergent compositions, pre-treatment compositions, hard surface cleaning compositions and dish washing detergent compositions. In particular non-aqueous liquid compositions and solid compositions, in particular granular compositions, tablets, extrudates and bars are envisaged herein.

The composition may comprise the acid source and the carbon dioxide source as separate particulate components. The compositions preferably comprise the effervescence component in the form of a effervescence granule. It may be preferred that all the acid of the composition, is comprised in the dry effervescence granule. Alternatively, it may be preferred that the composition comprises an effervescence granule and a dry-added acid and/or a dry-added carbon dioxide source.

In a preferred embodiment, the solid detergent composition herein comprises detergent base granules, whereof at least one comprises at lest one effervescence component, preferably in granular form. Then, the detergent base granules preferably have an weight average particle size of 350 microns to 4 mm, more preferably from 500 microns to 2.5 mm or even from 710 microns to 2 mm.

Preferably, the effervescence component of the invention is present in a detergent granule comprising ingredients which may incur dispensing or dissolution problems or which require faster dissolution, such as surfactants, in particular nonionic surfactants and or anionic surfactants, and detergent actives such as bleach activators and mixtures of surfactants and builders, in particular aluminosilicate builder and anionic surfactants.

This detergent base granule may be made by any process and may comprise any detergent ingredient. Preferred may be that the detergent base granule is made in a process whereby different detergent granules comprising different mixtures of detergent ingredients, preferably granulated by agglomeration, spray-drying or extrusion, are mixed and subsequently compacted, agglomerated, spheronised, or marumerised or extruded, optionally with addition of a binder. Thus, preferred may be that the effervescence granule herein and other granular detergent components are mixed with a binder and subsequently submitted to a granulation step, such as agglomeration, spheronisation, or marumerisation.

It has been found that when the effervescence component of the invention is present in a granule of a large particle size, improved sudsing of the detergent composition is obtained. Thus, the present invention provides a method for providing improved sudsing of a detergent composition by incorporation of an effervescence component of the invention in a detergent granule (including the effervescence component in granular form, described herein) having a weight average particle size from 500 microns to 1500 microns whereby preferably at least 70% of said granule has a particle size from 350 to 2000 microns, or even having a weight average particle size from 650 microns to 1180 microns whereby preferably at least 70% of said granule has a particle size from 500 to 1500 microns.

Also, it has been found that when the effervescence component of the invention is present in a granule of a small particle size more efficient dispensing and/or dissolution of the detergent composition is obtained. Thus, the present invention provides a method for providing improved dispensing and/or dissolution of a detergent composition by incorporation of an effervescence component according to any of claims 1 to 13 in a detergent granule having a weight average particle size from 200 microns to 500 microns whereby preferably at least 70% of said granule has a particle size from 100 to 710 microns, or even having a weight average particle size from 250 microns to 450 microns whereby preferably at least 70% of said granule has a particle size from 150 to 650 microns.

The granular compositions of the present invention can be prepared with different bulk densities, preferably being from 300 to 1200 g/l, preferably from 500 to 1100 g/l. These compositions can be made by a variety of methods well known in the art, including dry-mixing, spray drying, agglomeration and granulation and combinations thereof.

In a preferred embodiment, the composition comprises from 0.1% to 99% by weight of the total composition of the effervescent component or granule, preferably from 2% to 50%, or even from 3% to 25% by weight.

In a preferred embodiment, the composition preferably comprises granules whereof at least 60%, more preferably at least 80% by weight have an average particle size, by weight, of from 600 microns to 1400 microns, preferably from 700 microns to 1100 microns or even 750 to 1000 microns. It may be preferred that the compositions comprises less than 20% or even less than 10% or even less than 5% by weight of particulate components of a particle size of less than 300 microns, or even less than 425 microns or even less than 600 microns; it may also be preferred the composition comprise less than 20% or even less than 10% or even less than 5% by weight of the composition, of particulate components of a particle size of more than 1700 microns, or even more than 1400 microns or even more than 1180 microns.

The composition can be made by any method known in the art, including by agglomeration and/or spray-drying, whereby certain ingredients may be admixed or sprayed-on as described herein. It may be preferred that the composition is made by mixing all or part of the granules, including those made by agglomeration or spray-drying and even including the effervescence composition herein, and subsequently adding a binder and mixing or agglomerating the granules and binder to form the, preferably agglomerated detergent granules. These may be of the required particle size or they may be sieved to obtain particles of the required size.

The compositions in accord with the invention may also contain additional detergent components. The precise nature of these additional components, and levels of incorporation thereof will depend on the physical form of the composition or component, and the precise nature of the washing operation for which it is to be used.

When present in detergent compositions, it may also be preferred that only less than 25% by weight of the detergent composition of admixed hydratable inorganic salts are present, being thus present as separate particles, or even less than 25% by weight of the detergent composition of hydratable inorganic salts in the total composition. It may be preferred that a inorganic peroxygen bleach is present, whereby it is preferred that a percarboante salt is present.

In one embodiment of the invention, it may be preferred that the detergent composition herein comprise one or more anionic surfactants and an aluminosilicate builder, whereby it is preferred that only small amounts of the aluminosilicate builder and the anionic surfactant are in an intimate mixture, i.e. less than 50% or even less than 30% of the total amount of the anionic surfactant and less than 50% or even less than 30% of the total amount of alumnisilicate; it may even be preferred that substantially no anionic surfactant and aluminosilicate builder are in an intimate mixture. Thus, it may be preferred that the composition comprises at least two separate particles which comprise either anionic surfactant or aluminosilicate. 'Intimate mixture' means for the purpose of the invention that the two or more ingredients the component are substantially homogeneously divided in the component or particle. Namely, it has been found that the solubility and/or dispensing of the composition is thereby improved.

In another embodiment of the invention, it may be preferred that the composition only comprises low levels of aluminosilicate builder, for example less than 10% or even less than 5% by weight of the composition, whereby it is preferred that the composition comprises highly soluble builders, for example sodium citrate or citric acid, carbonate, and/or crystalline layered silicate.

It may also be preferred that the composition comprises as builder system or as part of the builder system, an agglomerate comprising from 0.5% to 80% by weight a crystalline layered silicate, preferably, NaSKS-6, and from 10% to 70% by weight of a surfactant, preferably an anionic surfactant, whereby it may be preferred that less than 10% by weight of the agglomerate of free moisture, more preferably 30% to 60% by weight a crystalline layered silicate and 20% to 50% by weight of an anionic surfactant.

The effervescence component of the invention may contain one or more additional detergent components as described herein and the detegrent compositions herein preferably comprise one or more ingredients selected from the following:

Surfactant

The components in accord with the invention and the compositons herein preferably contain one or more surfactants selected from anionic, nonionic, cationic, ampholytic, amphoteric and zwitterionic surfactants and mixtures thereof.

A typical listing of anionic, nonionic, ampholytic, and zwitterionic classes, and species of these surfactants, is given in U.S. Pat. No. 3,929,678 issued to Laughlin and Heuring on Dec. 30, 1975. Further examples are given in "Surface Active Agents and Detergents" (Vol. I and II by Schwartz, Perry and Berch). A list of suitable cationic surfactants is given in U.S. Pat. No. 4,259,217 issued to Murphy on Mar. 31, 1981.

Where present, ampholytic, amphoteric and zwitteronic surfactants are generally used in combination with one or more anionic and/or nonionic surfactants.

Anionic Surfactant

The components in accord with the present invention and/or the detergent compositions herein preferably comprise an additional anionic surfactant. Essentially any anionic surfactants useful for detersive purposes can be comprised in the detergent composition. These can include salts (including, for example, sodium, potassium, ammonium, and substituted ammonium salts such as mono-, di- and triethanolamine salts) of the anionic sulfate, sulfonate, carboxylate and sarcosinate surfactants. Anionic sulfate and sulfonate surfactants are preferred.

The anionic surfactants is preferably present at a level of from 0.1% to 60%, more preferably from 1 to 40%, most preferably from 5% to 30% by weight.

Highly preferred are surfactants systems comprising a sulfonate and a sulfate surfactant, preferably a linear or branched alkyl benzene sulfonate and alkyl ethoxylsulfates, as described herein, preferably combined with a cationic surfactants as described herein.

Other anionic surfactants include the isethionates such as the acyl isethionates, N-acyl taurates, fatty acid amides of methyl tauride, alkyl succinates and sulfosuccinates, monoesters of sulfosuccinate (especially saturated and unsaturated $C_{12}$–$C_{18}$ monoesters) diesters of sulfosuccinate (especially saturated and unsaturated $C_6$–$C_{14}$ diesters), N-acyl sarcosinates. Resin acids and hydrogenated resin acids are also suitable, such as rosin, hydrogenated rosin, and resin acids and hydrogenated resin acids present in or derived from tallow oil.

Anionic Sulfate Surfactant

Anionic sulfate surfactants suitable for use herein include the linear and branched primary and secondary alkyl sulfates, alkyl ethoxysulfates, fatty oleoyl glycerol sulfates, alkyl phenol ethylene oxide ether sulfates, the $C_5$–$C_{17}$ acyl-N—($C_1$–$C_4$ alkyl) and -N—($C_1$–$C_2$ hydroxyalkyl) glucamine sulfates, and sulfates of alkylpolysaccharides such as the sulfates of alkylpolyglucoside (the nonionic nonsulfated compounds being described herein).

Alkyl sulfate surfactants are preferably selected from the linear and branched primary $C_{10}$–$C_{18}$ alkyl sulfates, more preferably the $C_{11}$–$C_{15}$ branched chain alkyl sulfates and the $C_{12}$–$C_{14}$ linear chain alkyl sulfates.

Alkyl ethoxysulfate surfactants are preferably selected from the group consisting of the $C_{10}$–$C_{18}$ alkyl sulfates which have been ethoxylated with from 0.5 to 20 moles of ethylene oxide per molecule. More preferably, the alkyl ethoxysulfate surfactant is a $C_{11}$–$C_{18}$, most preferably $C_{11}$–$C_{15}$ alkyl sulfate which has been ethoxylated with from 0.5 to 7, preferably from 1 to 5, moles of ethylene oxide per molecule.

A particularly preferred aspect of the invention employs mixtures of the preferred alkyl sulfate and/or sulfonate and alkyl ethoxysulfate surfactants. Such mixtures have been disclosed in PCT patent application Ser. No. WO 93/18124.

Anionic Sulfonate Surfactant

Anionic sulfonate surfactants suitable for use herein include the salts of $C_5$–$C_{20}$ linear alkylbenzene sulfonates, alkyl ester sulfonates, $C_6$–$C_{22}$ primary or secondary alkane sulfonates, $C_6$–$C_{24}$ olefin sulfonates, sulfonated polycarboxylic acids, alkyl glycerol sulfonates, fatty acyl glycerol sulfonates, fatty oleyl glycerol sulfonates, and any mixtures thereof.

Anionic Carboxylate Surfactant

Suitable anionic carboxylate surfactants include the alkyl ethoxy carboxylates, the alkyl polyethoxy polycarboxylate surfactants and the soaps ('alkyl carboxyls'), especially certain secondary soaps as described herein.

Suitable alkyl ethoxy carboxylates include those with the formula $RO(CH_2CH_2O)_x\ CH_2COO^-M^+$ wherein R is a $C_6$ to $C_{18}$ alkyl group, x ranges from O to 10, and the ethoxylate distribution is such that, on a weight basis, the amount of material where x is 0 is less than 20% and M is a cation. Suitable alkyl polyethoxy polycarboxylate surfactants include those having the formula RO—($CHR_1$—$CHR_2$—O)—$R_3$ wherein R is a $C_6$ to $C_{18}$ alkyl group, x is from 1 to 25, $R_1$ and $R_2$ are selected from the group consisting of hydrogen, methyl acid radical, succinic acid radical, hydroxysuccinic acid radical, and mixtures thereof, and $R_3$ is selected from the group consisting of hydrogen, substituted or unsubstituted hydrocarbon having between 1 and 8 carbon atoms, and mixtures thereof.

Suitable soap surfactants include the secondary soap surfactants which contain a carboxyl unit connected to a secondary carbon. Preferred secondary soap surfactants for use herein are water-soluble members selected from the group consisting of the water-soluble salts of 2-methyl-1-undecanoic acid, 2-ethyl-1-decanoic acid, 2-propyl-1-nonanoic acid, 2-butyl-1-octanoic acid and 2-pentyl-1-heptanoic acid.

Certain soaps may also be included as suds suppressors.

Alkali Metal Sarcosinate Surfactant

Other suitable anionic surfactants are the alkali metal sarcosinates of formula R—CON ($R^1$)$CH_2$COOM, wherein R is a $C_5$–$C_{17}$ linear or branched alkyl or alkenyl group, $R^1$ is a $C_1$–$C_4$ alkyl group and M is an alkali metal ion. Preferred examples are the myristyl and oleoyl methyl sarcosinates in the form of their sodium salts.

Alkoxylated Nonionic Surfactant

Essentially any alkoxylated nonionic surfactants are suitable herein. The ethoxylated and propoxylated nonionic surfactants are preferred.

Preferred alkoxylated surfactants can be selected from the classes of the nonionic condensates of alkyl phenols, nonionic ethoxylated alcohols, nonionic ethoxylated/propoxylated fatty alcohols, nonionic ethoxylate/propoxylate condensates with propylene glycol, and the nonionic ethoxylate condensation products with propylene oxide/ethylene diamine adducts.

Nonionic Alkoxylated Alcohol Surfactant

The condensation products of aliphatic alcohols with from 1 to 25 moles of alkylene oxide, particularly ethylene oxide and/or propylene oxide, are suitable for use herein. The alkyl chain of the aliphatic alcohol can either be straight or branched, primary or secondary, and generally contains from 6 to 22 carbon atoms. Particularly preferred are the condensation products of alcohols having an alkyl group containing from 8 to 20 carbon atoms with from 2 to 10 moles of ethylene oxide per mole of alcohol.

Nonionic Polyhydroxy Fatty Acid Amide Surfactant

Polyhydroxy fatty acid amides suitable for use herein are those having the structural formula $R^2CONR^1Z$ wherein: R1 is H, $C_1$–$C_4$ hydrocarbyl, 2-hydroxy ethyl, 2-hydroxy propyl, ethoxy, propoxy, or a mixture thereof, preferable $C_1$–$C_4$ alkyl, more preferably $C_1$ or $C_2$ alkyl, most preferably $C_1$ alkyl (i.e., methyl); and $R_2$ is a $C_5$–$C_{31}$ hydrocarbyl, preferably straight-chain $C_5$–$C_{19}$ alkyl or alkenyl, more preferably straight-chain $C_9$–$C_{17}$ alkyl or alkenyl, most preferably straight-chain $C_{11}$–$C_{17}$ alkyl or alkenyl, or mixture thereof; and Z is a polyhydroxyhydrocarbyl having a linear hydrocarbyl chain with at least 3 hydroxyls directly connected to the chain, or an alkoxylated derivative (preferably ethoxylated or propoxylated) thereof. Z preferably will be derived from a reducing sugar in a reductive amination reaction; more preferably Z is a glycityl.

Nonionic Fatty Acid Amide Surfactant

Suitable fatty acid amide surfactants include those having the formula: $R^6CON(R^7)_2$ wherein $R^6$ is an alkyl group containing from 7 to 21, preferably from 9 to 17 carbon atoms and each $R^7$ is selected from the group consisting of hydrogen, $C_1$–$C_4$ alkyl, $C_1$–$C_4$ hydroxyalkyl, and —$(C_2H_4O)_xH$, where x is in the range of from 1 to 3.

Nonionic Alkylpolysaccharide Surfactant

Suitable alkylpolysaccharides for use herein are disclosed in U.S. Pat. No. 4,565,647, Llenado, issued Jan. 21, 1986, having a hydrophobic group containing from 6 to 30 carbon atoms and a polysaccharide, e.g., a polyglycoside, hydrophilic group containing from 1.3 to 10 saccharide units.

Preferred alkylpolyglycosides have the formula:

$$R^2O(C_nH_{2n}O)t(\text{glycosyl})_x$$

wherein $R^2$ is selected from the group consisting of alkyl, alkylphenyl, hydroxyalkyl, hydroxyalkylphenyl, and mixtures thereof in which the alkyl groups contain from 10 to 18 carbon atoms; n is 2 or 3; t is from 0 to 10, and x is from 1.3 to 8. The glycosyl is preferably derived from glucose.

Amphoteric Surfactant

Suitable amphoteric surfactants for use herein include the amine oxide surfactants and the alkyl amphocarboxylic acids.

Suitable amine oxides include those compounds having the formula $R^3(OR^4)_xN^0(R^5)_2$ wherein $R^3$ is selected from an alkyl, hydroxyalkyl, acylamidopropoyl and alkyl phenyl group, or mixtures thereof, containing from 8 to 26 carbon atoms; $R^4$ is an alkylene or hydroxyalkylene group containing from 2 to 3 carbon atoms, or mixtures thereof; x is from 0 to 5, preferably from 0 to 3; and each $R^5$ is an alkyl or hydroxyalkyl group containing from 1 to 3, or a polyethylene oxide group containing from 1 to 3 ethylene oxide groups. Preferred are $C_{10}$–$C_{18}$ alkyl dimethylamine oxide, and $C_{10}$–$C_{18}$ acylamido alkyl dimethylamine oxide.

A suitable example of an alkyl aphodicarboxylic acid is Miranol(TM) C2M Conc. manufactured by Miranol, Inc., Dayton, N.J.

Zwitterionic Surfactant

Zwitterionic surfactants can also be incorporated into the detergent compositions in accord with the invention. These surfactants can be broadly described as derivatives of secondary and tertiary amines, derivatives of heterocyclic secondary and tertiary amines, or derivatives of quaternary ammonium, quaternary phosphonium or tertiary sulfonium compounds. Betaine and sultaine surfactants are exemplary zwitterionic surfactants for use herein.

Suitable betaines are those compounds having the formula $R(R')_2N^+R^2COO^-$ wherein R is a $C_6$–$C_{18}$ hydrocarbyl group, each $R^1$ is typically $C_1$–$C_3$ alkyl, and $R^2$ is a $C_1$–$C_5$ hydrocarbyl group. Preferred betaines are $C_{12}$–$C_{18}$ dimethyl-ammonio hexanoate and the $C_{10}$–$C_{18}$ acylamidopropane (or ethane) dimethyl (or diethyl) betaines. Complex betaine surfactants are also suitable for use herein.

Cationic Surfactants

Suitable cationic surfactants to be used herein include the quaternary ammonium surfactants. Preferably the quaternary ammonium surfactant is a mono $C_6$–$C_{16}$, preferably $C_6$–$C_{10}$ N-alkyl or alkenyl ammonium surfactants wherein the remaining N positions are substituted by methyl, hydroxyethyl or hydroxypropyl groups. Preferred are also the mono-alkoxylated and bis-alkoxylated amine surfactants.

Another suitable group of cationic surfactants which can be used in the detergent compositions or components thereof herein are cationic ester surfactants. The cationic ester surfactant is a, preferably water dispersible, compound having surfactant properties comprising at least one ester (i.e. —COO—) linkage and at least one cationically charged group.

Suitable cationic ester surfactants, including choline ester surfactants, have for example been disclosed in U.S. Pat. Nos. 4,228,042, 4,239,660 and 4,260,529.

In one preferred aspect the ester linkage and cationically charged group are separated from each other in the surfactant molecule by a spacer group consisting of a chain comprising at least three atoms (i.e. of three atoms chain length), preferably from three to eight atoms, more preferably from three to five atoms, most preferably three atoms. The atoms forming the spacer group chain are selected from the group consisting of carbon, nitrogen and oxygen atoms and any mixtures thereof, with the proviso that any nitrogen or oxygen atom in said chain connects only with carbon atoms in the chain. Thus spacer groups having, for example, —O—O— (i.e. peroxide), —N—N—, and —N—O— linkages are excluded, whilst spacer groups having, for example $—CH_2—O—CH_2—$ and $—CH_2—NH—CH_2—$ linkages are included. In a preferred aspect the spacer group chain comprises only carbon atoms, most preferably the chain is a hydrocarbyl chain.

Cationic Mono-Alkoxylated Amine Surfactants

Highly preferred herein are cationic mono-alkoxylated amine surfactant preferably of the general formula I:

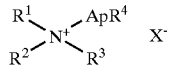

(I)

wherein $R^1$ is an alkyl or alkenyl moiety containing from about 6 to about 18 carbon atoms, preferably 6 to about 16 carbon atoms, most preferably from about 6 to about 14 carbon atoms; $R^2$ and $R^3$ are each independently alkyl groups containing from one to about three carbon atoms, preferably methyl, most preferably both $R^2$ and $R^3$ are methyl groups; $R^4$ is selected from hydrogen (preferred), methyl and ethyl; $X^-$ is an anion such as chloride, bromide, methylsulfate, sulfate, or the like, to provide electrical neutrality; A is a alkoxy group, especially a ethoxy, propoxy or butoxy group; and p is from 0 to about 30, preferably 2 to about 15, most preferably 2 to about 8.

Preferably the $ApR^4$ group in formula I has p=1 and is a hydroxyalkyl group, having no greater than 6 carbon atoms whereby the —OH group is separated from the quaternary ammonium nitrogen atom by no more than 3 carbon atoms. Particularly preferred $ApR^4$ groups are $—CH_2CH_2OH$, $—CH_2CH_2CH_2OH$, $—CH_2CH(CH_3)OH$ and $—CH(CH_3)CH_2OH$, with $—CH_2CH_2OH$ being particularly preferred. Preferred $R^1$ groups are linear alkyl groups. Linear $R^1$ groups having from 8 to 14 carbon atoms are preferred.

Another highly preferred cationic mono-alkoxylated amine surfactants for use herein are of the formula

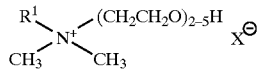

wherein R is $C_{10}$–$C_{18}$ hydrocarbyl and mixtures thereof, especially $C_{10}$–$C_{14}$ alkyl, preferably $C_{10}$ and $C_{12}$ alkyl, and X is any convenient anion to provide charge balance, preferably chloride or bromide.

As noted, compounds of the foregoing type include those wherein the ethoxy ($CH_2CH_2O$) units (EO) are replaced by butoxy, isopropoxy [$CH(CH_3)CH_2O$] and [$CH_2CH(CH_3O$] units (i-Pr) or n-propoxy units (Pr), or mixtures of EO and/or Pr and/or i-Pr units.

The levels of the cationic mono-alkoxylated amine surfactants is preferably from 0.1% to 20%, more preferably from 0.2% to 7%, most preferably from 0.3% to 3.0% by weight.

Cationic bis-Alkoxylated Amine Surfactant

The cationic bis-alkoxylated amine surfactant preferably has the general formula II:

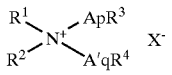

(II)

wherein $R^1$ is an alkyl or alkenyl moiety containing from about 8 to about 18 carbon atoms, preferably 10 to about 16 carbon atoms, most preferably from about 10 to about 14 carbon atoms; $R^2$ is an alkyl group containing from one to three carbon atoms, preferably methyl; $R^3$ and $R^4$ can vary independently and are selected from hydrogen (preferred), methyl and ethyl, $X^-$ is an anion such as chloride, bromide, methylsulfate, sulfate, or the like, sufficient to provide electrical neutrality. A and A' can vary independently and are each selected from $C_1$–$C_4$ alkoxy, especially ethoxy, (i.e., —$CH_2CH_2O$—), propoxy, butoxy and mixtures thereof; p is from 1 to about 30, preferably 1 to about 4 and q is from 1 to about 30, preferably 1 to about 4, and most preferably both p and q are 1.

Highly preferred cationic bis-alkoxylated amine surfactants for use herein are of the formula

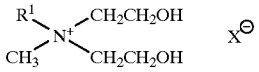

wherein $R^1$ is $C_{10}$–$C_{18}$ hydrocarbyl and mixtures thereof, preferably $C_{10}$, $C_{12}$, $C_{14}$ alkyl and mixtures thereof. X is any convenient anion to provide charge balance, preferably chloride. With reference to the general cationic bis-alkoxylated amine structure noted above, since in a preferred compound $R^1$ is derived from (coconut) $C_{12}$–$C_{14}$ alkyl fraction fatty acids, $R^2$ is methyl and $ApR^3$ and $A'qR^4$ are each monoethoxy.

Other cationic bis-alkoxylated amine surfactants useful herein include compounds of the formula:

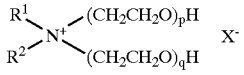

wherein R is $C_{10}$–$C_{18}$ hydrocarbyl, preferably $C_{10}$–$C_{14}$ alkyl, independently p is 1 to about 3 and q is 1 to about 3, $R^2$ is $C_1$–$C_3$ alkyl, preferably methyl, and X is an anion, especially chloride or bromide.

Other compounds of the foregoing type include those wherein the ethoxy ($CH_2CH_2O$) units (EO) are replaced by butoxy (Bu) isopropoxy [$CH(CH_3)CH_2O$] and [$CH_2CH(CH_3O$] units (i-Pr) or n-propoxy units (Pr), or mixtures of EO and/or Pr and/or i-Pr units.

Bleach Activator

The components in accord with the present invention and/or the detergent compositions herein preferably comprises a bleach activator, preferably comprising an organic peroxyacid bleach precursor. It may be preferred that the composition comprises at least two peroxy acid bleach precursors, preferably at least one hydrophobic peroxyacid bleach precursor and at least one hydrophilic peroxy acid bleach precursor, as defined herein. The production of the organic peroxyacid occurs then by an in situ reaction of the precursor with a source of hydrogen peroxide.

The bleach activator may alternatively, or in addition comprise a preformed peroxy acid bleach.

It is preferred that the bleach activator is present in a particulate component in the component or compositions herein. It may be preferred that the is present as a separate, admixed particle. Alternatively, the bleach activator or part thereof can be present in the base detergent particle.

Preferably, at least one of the bleach activators, preferably a peroxy acid bleach precursor, is present in a particulate component having an average particle size, by weight, of from 600 microns to 1400 microns, preferably from 700 microns to 1100 microns. More preferably, all of the activator are present in one or more particulate components having the specified weight average particle size.

Hereby, it may be preferred that at least 80%, preferably at least 90% or even at least 95% or even substantially 100% of the component or components comprising the bleach activator have a particle size of from 300 microns to 1700 microns, preferably from 425 microns to 1400 microns.

The hydrophobic peroxy acid bleach precursor preferably comprises a compound having a oxy-benzene sulphonate group, preferably NOBS, DOBS, LOBS and/or NACA-OBS, as described herein.

The hydrophilic peroxy acid bleach precursor preferably comprises TAED, as described herein.

Peroxyacid Bleach Precursor

Peroxyacid bleach precursors are compounds which react with hydrogen peroxide in a perhydrolysis reaction to produce a peroxyacid. Generally peroxyacid bleach precursors may be represented as

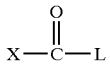

where L is a leaving group and X is essentially any functionality, such that on perhydroloysis the structure of the peroxyacid produced is

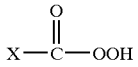

For the purpose of the invention, hydrophobic peroxyacid bleach precursors produce a peroxy acid of the formula above wherein X is a group comprising at least 6 carbon atoms and a hydrophilic peroxyacid bleach precursor produces a peroxyacid bleach of the formula above wherein X is a group comprising 1 to 5 carbon atoms.

Peroxyacid bleach precursor compounds are preferably incorporated at a level of from 0.5% to 30% by weight, more preferably from 1% to 15% by weight, most preferably from 1.5% to 10% by weight. The ratio of hydrophilic to hydrophobic bleach precursors, when present, is preferably from 10:1 to 1:10, more preferably from 5:1 to 1:5 or even from 3:1 to 1:3.

Suitable peroxyacid bleach precursor compounds typically contain one or more N- or O-acyl groups, which precursors can be selected from a wide range of classes. Suitable classes include anhydrides, esters, imides, lactams and acylated derivatives of imidazoles and oximes. Examples of useful materials within these classes are disclosed in GB-A-1586789. Suitable esters are disclosed in GB-A-836988, 864798, 1147871, 2143231 and EP-A-0170386.

Leaving Groups

The leaving group, hereinafter L group, must be sufficiently reactive for the perhydrolysis reaction to occur within the optimum time frame (e.g., a wash cycle). However, if L is too reactive, this activator will be difficult to stabilize for use in a bleaching composition.

Preferred L groups are selected from the group consisting of:

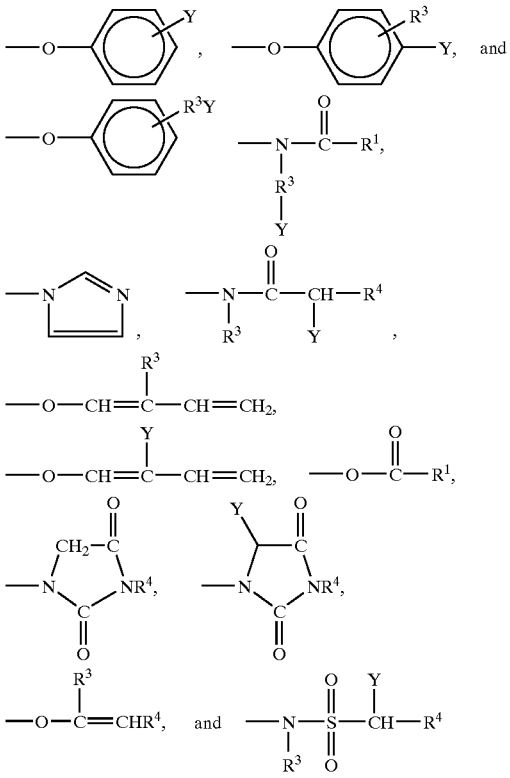

and mixtures thereof, wherein $R^1$ is an alkyl, aryl, or alkaryl group containing from 1 to 14 carbon atoms, $R^3$ is an alkyl chain containing from 1 to 8 carbon atoms, $R^4$ is H or $R^3$, and Y is H or a solubilizing group. Any of $R^1$, $R^3$ and $R^4$ may be substituted by essentially any functional group including, for example alkyl, hydroxy, alkoxy, halogen, amine, nitrosyl, amide and ammonium or alkyl ammonium groups.

The preferred solubilizing groups are $—SO_3^-M^+$, $—CO_2^-M^+$, $—SO_4^-M^+$, $—N^+(R^3)_4X^-$ and $O←N(R^3)_3$ and most preferably $—SO_3^-M^+$ and $—CO_2^-M^+$ wherein $R^3$ is an alkyl chain containing from 1 to 4 carbon atoms, M is a cation which provides solubility to the bleach activator and X is an anion which provides solubility to the bleach activator. Preferably, M is an alkali metal, ammonium or substituted ammonium cation, with sodium and potassium being most preferred, and X is a halide, hydroxide, methylsulfate or acetate anion.

Alkyl Percarboxylic Acid Bleach Precursors

Alkyl percarboxylic acid bleach precursors form percarboxylic acids on perhydrolysis. Preferred precursors of this type provide peracetic acid on perhydrolysis.

Preferred alkyl percarboxylic precursor compounds of the imide type include the $N,N,N^1N^1$ tetra acetylated alkylene diamines wherein the alkylene group contains from 1 to 6 carbon atoms, particularly those compounds in which the alkylene group contains 1, 2 and 6 carbon atoms. Tetraacetyl ethylene diamine (TAED) is particularly preferred as hydrophilic peroxy acid bleach precursor.

Other preferred alkyl percarboxylic acid precursors include sodium 3,5,5-tri-methyl hexanoyloxybenzene sulfonate (iso-NOBS), sodium nonanoyloxybenzene sulfonate (NOBS), sodium acetoxybenzene sulfonate (ABS) and pentaacetyl glucose.

Amide Substituted Alkyl Peroxyacid Precursors

Amide substituted alkyl peroxyacid precursor compounds are suitable herein, including those of the following general formulae:

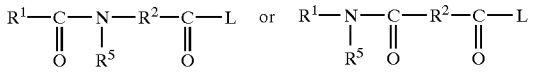

wherein $R^1$ is an aryl or alkaryl group with from about 1 to about 14 carbon atoms, $R^2$ is an alkylene, arylene, and alkarylene group containing from about 1 to 14 carbon atoms, and $R^5$ is H or an alkyl, aryl, or alkaryl group containing 1 to 10 carbon atoms and L can be essentially any leaving group. $R^1$ preferably contains from about 6 to 12 carbon atoms. $R^2$ preferably contains from about 4 to 8 carbon atoms. $R^1$ may be straight chain or branched alkyl, substituted aryl or alkylaryl containing branching, substitution, or both and may be sourced from either synthetic sources or natural sources including for example, tallow fat. Analogous structural variations are permissible for $R^2$. $R^2$ can include alkyl, aryl, wherein said $R^2$ may also contain halogen, nitrogen, sulphur and other typical substituent groups or organic compounds. $R^5$ is preferably H or methyl. $R^1$ and $R^5$ should not contain more than 18 carbon atoms total. Amide substituted bleach activator compounds of this type are described in EP-A-0170386. It can be preferred that $R^1$ and $R^5$ forms together with the nitrogen and carbon atom a ring structure.

Preferred examples of bleach precursors of this type include amide substituted peroxyacid precursor compounds selected from (6-octanamido-caproyl)oxybenzenesulfonate, (6-decanamido-caproyl)oxybenzene-sulfonate, and the highly preferred (6-nonanamidocaproyl)oxybenzene sulfonate, and mixtures thereof as described in EP-A-0170386.

Perbenzoic Acid Precursor

Perbenzoic acid precursor compounds provide perbenzoic acid on perhydrolysis. Suitable O-acylated perbenzoic acid precursor compounds include the substituted and unsubstituted benzoyl oxybenzene sulfonates, and the benzoylation products of sorbitol, glucose, and all saccharides with benzoylating agents, and those of the imide type including N-benzoyl succinimide, tetrabenzoyl ethylene diamine and the N-benzoyl substituted ureas. Suitable imidazole type perbenzoic acid precursors include N-benzoyl imidazole and N-benzoyl benzimidazole. Other useful N-acyl group-containing perbenzoic acid precursors include N-benzoyl pyrrolidone, dibenzoyl taurine and benzoyl pyroglutamic acid.

Cationic Peroxyacid Precursors

Cationic peroxyacid precursor compounds produce cationic peroxyacids on perhydrolysis.

Typically, cationic peroxyacid precursors are formed by substituting the peroxyacid part of a suitable peroxyacid precursor compound with a positively charged functional group, such as an ammonium or alkyl ammonium group, preferably an ethyl or methyl ammonium group. Cationic peroxyacid precursors are typically present in the solid detergent compositions as a salt with a suitable anion, such as a halide ion.

The peroxyacid precursor compound to be so cationically substituted may be a perbenzoic acid, or substituted derivative thereof, precursor compound as described hereinbefore. Alternatively, the peroxyacid precursor compound may be an alkyl percarboxylic acid precursor compound or an amide substituted alkyl peroxyacid precursor as described hereinafter.

Cationic peroxyacid precursors are described in U.S. Pat. Nos. 4,904,406; 4,751,015; 4,988,451; 4,397,757; 5,269,962; 5,127,852; 5,093,022; 5,106,528; U.K. 1,382,594; EP 475,512, 458,396 and 284,292; and in JP 87-318,332.

Examples of preferred cationic peroxyacid precursors are described in UK Patent Application No. 9407944.9 and U.S. patent application Ser. No. 08/298903 now U.S. Pat. No. 5,686,015, Ser. No. 08/298650 now U.S. Pat. No. 5,460,747, Ser. No. 08/298904 now U.S. Pat. No. 5,578,136 and Ser. No. 08/298906 now U.S. Pat. No 5,514,888.

Suitable cationic peroxyacid precursors include any of the ammonium or alkyl ammonium substituted alkyl or benzoyl oxybenzene sulfonates, N-acylated caprolactams, and monobenzoyltetraacetyl glucose benzoyl peroxides. Preferred cationic peroxyacid precursors of the N-acylated caprolactam class include the trialkyl ammonium methylene benzoyl caprolactams and the trialkyl ammonium methylene alkyl caprolactams.

Benzoxazin Organic Peroxyacid Precursors

Also suitable are precursor compounds of the benzoxazin-type, as disclosed for example in EP-A-332,294 and EP-A-482,807, particularly those having the formula:

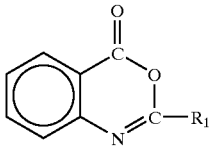

wherein $R_1$ is H, alkyl, alkaryl, aryl, or arylalkyl.

Preformed Organic Peroxyacid

The components in accord with the present invention and/or the detergent compositions herein may contain, in addition to, or as an alternative to, an organic peroxyacid bleach precursor compound, a preformed organic peroxyacid, typically at a level of from 1% to 15% by weight, more preferably from 1% to 10% by weight.

A preferred class of organic peroxyacid compounds are the amide substituted compounds of the following general formulae:

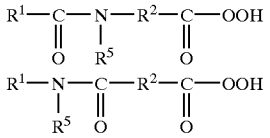

wherein $R^1$ is an alkyl, aryl or alkaryl group with from 1 to 14 carbon atoms, $R^2$ is an alkylene, arylene, and alkarylene group containing from 1 to 14 carbon atoms, and $R^5$ is H or an alkyl, aryl, or alkaryl group containing 1 to 10 carbon atoms. Amide substituted organic peroxyacid compounds of this type are described in EP-A-0170386.

Other organic peroxyacids include diacyl and tetraacylperoxides, especially diperoxydodecanedioc acid, diperoxytetradecanedioc acid and diperoxyhexadecanedioc acid. Mono- and diperazelaic acid, mono- and diperbrassylic acid and N-phthaloylaminoperoxicaproic acid are also suitable herein.

Peroxide Source

Inorganic perhydrate salts are a preferred source of peroxide. Preferably these salts are present at a level of from 0.01% to 50% by weight, more preferably of from 0.5% to 30% by weight of the composition or component.

Examples of inorganic perhydrate salts include perborate, percarbonate, perphosphate, persulfate and persilicate salts. The inorganic perhydrate salts are normally the alkali metal salts. The inorganic perhydrate salt may be included as the crystalline solid without additional protection. For certain perhydrate salts however, the preferred executions of such granular compositions utilize a coated form of the material which provides better storage stability for the perhydrate salt in the granular product. Suitable coatings comprise inorganic salts such as alkali metal silicate, carbonate or borate salts or mixtures thereof, or organic materials such as waxes, oils, or fatty soaps.

Sodium perborate is a preferred perhydrate salt and can be in the form of the monohydrate of nominal formula $NaBO_2H_2O_2$ or the tetrahydrate $NaBO_2H_2O_2.3H_2O$.

Alkali metal percarbonates, particularly sodium percarbonate are preferred perhydrates herein. Sodium percarbonate is an addition compound having a formula corresponding to $2Na_2CO_3.3H_2O_2$, and is available commercially as a crystalline solid.

Potassium peroxymonopersulfate is another inorganic perhydrate salt of use in the detergent compositions herein.

Dye

A preferred ingredients of the compositions herein are dyes and dyed particles or speckles, which can be bleach-sensitive. The dye as used herein can be a dye stuff or an aqueous or nonaqueous solution of a dye stuff. It may be preferred that the dye is an aqueous solution comprising a dyestuff, at any level to obtain suitable dyeing of the detergent particles or speckles, preferably such that levels of dye solution are obtained up to 2% by weight of the dyed particle, or more preferably up to 0.5% by weight, as described above. The dye may also be mixed with a non-aqueous carrier material, such as non-aquous liquid materials including nonionic surfactants.

Optionally, the dye also comprising other ingredients such as organic binder materials, which may also be a non-aqueous liquid.

The dyestuff can be any suitable dyestuff. Specific examples of suitable dyestuffs include E104—food yellow 13 (quinoline yellow), E110—food yellow 3 (sunset yellow FCF), E131—food blue 5 (patent blue V), Ultra Marine blue (trade name), E133—food blue 2 (brilliant blue FCF), E140—natural green 3 (chlorophyll and chlorphyllins), E141 and Pigment green 7 (chlorinated Cu phthalocyanine). Preferred dyestuffs may be Monastral Blue BV paste (trade name) and/or Pigmasol Green (trade name).

The dyed detergent particles or effervescence components preferably comprise such a up to 10% or more preferably up to 2% or even up to 1% by weight of the dyed particle or component.

Perfumes

Another preferred ingredient of the component of the invention or the compositios herein is a perfume or perfume composition. Any perfume composition can be used herein. The perfumes may also be encapsulated.

Preferred perfumes containing at least one component with a low molecular weight volatile component, e.g. having a molecular weight of from 150 to 450 or preferably 350.

Preferably, the perfume component comprises an oxygen-containing functional group. Preferred functional groups are aldehyde, ketone, alcohol or ether functional groups or mixtures thereof.

Heavy Metal Ion Sequestrant

The components in accord with the present invention and/or the detergent compositions herein preferably contain as an optional component a heavy metal ion sequestrant or chelant or chelating agent. By heavy metal ion sequestrant it is meant herein components which act to sequester (chelate) heavy metal ions. These components may also have calcium and magnesium chelation capacity, but preferentially they show selectivity to binding heavy metal ions such as iron, manganese and copper.

Heavy metal ion sequestrants are generally present at a level of from 0.005% to 10%, preferably from 0.1% to 5%, more preferably from 0.25% to 7.5% and most preferably from 0.3% to 2% by weight of the compositions or component.

Suitable heavy metal ion sequestrants for use herein include organic phosphonates, such as the amino alkylene poly (alkylene phosphonates), alkali metal ethane 1-hydroxy disphosphonates and nitrilo trimethylene phosphonates.

Preferred among the above species are diethylene triamine penta (methylene phosphonate), ethylene diamine tri(methylene phosphonate)hexamethylene diamine tetra (methylene phosphonate) and hydroxy-ethylene 1,1 diphosphonate, 1,1 hydroxyethane diphosphonic acid and 1,1 hydroxyethane dimethylene phosphonic acid.

Other suitable heavy metal ion sequestrant for use herein include nitrilotriacetic acid and polyaminocarboxylic acids such as ethylenediaminotetracetic acid, ethylenediamine disuccinic acid, ethylenediamine diglutaric acid, 2-hydroxypropylenediamine disuccinic acid or any salts thereof.

Other suitable heavy metal ion sequestrants for use herein are iminodiacetic acid derivatives such as 2-hydroxyethyl diacetic acid or glyceryl imino diacetic acid, described in EP-A-317,542 and EP-A-399,133. The iminodiacetic acid-N-2-hydroxypropyl sulfonic acid and aspartic acid N-carboxymethyl N-2-hydroxypropyl-3-sulfonic acid sequestrants described in EP-A-516,102 are also suitable herein. The β-alanine-N,N'-diacetic acid, aspartic acid-N,N'-diacetic acid, aspartic acid-N-monoacetic acid and imino-disuccinic acid sequestrants described in EP-A-509,382 are also suitable.

EP-A-476,257 describes suitable amino based sequestrants. EP-A-510,331 describes suitable sequestrants derived from collagen, keratin or casein. EP-A-528,859 describes a suitable alkyl iminodiacetic acid sequestrant. Dipicolinic acid and 2-phosphonobutane-1,2,4-tricarboxylic acid are alos suitable. Glycinamide-N,N'-disuccinic acid (GADS), ethylenediamine-N-N'-diglutaric acid (EDDG) and 2-hydroxypropylenediamine-N-N'-disuccinic acid (HPDDS) are also suitable.

Especially preferred are diethylenetriamine pentacetic acid, ethylenediamine-N,N'-disuccinic acid (EDDS) and 1,1 hydroxyethane diphosphonic acid or the alkali metal, alkaline earth metal, ammonium, or substituted ammonium salts thereof, or mixtures thereof.

In particular the chelating agents comprising a amino or amine group can be bleach-sensitive and are suitable in the compositions of the invention.

Enzyme

Another highly preferred ingredient useful in the components or compositions herein is one or more additional enzymes.

Preferred additional enzymatic materials include the commercially available lipases, cutinases, amylases, neutral and alkaline proteases, cellulases, endolases, esterases, pectinases, lactases and peroxidases conventionally incorporated into detergent compositions. Suitable enzymes are discussed in U.S. Pat. Nos. 3,519,570 and 3,533,139.

Preferred commercially available protease enzymes include those sold under the tradenames Alcalase, Savinase, Primase, Durazym, and Esperase by Novo Industries A/S (Denmark), those sold under the tradename Maxatase, Maxacal and Maxapem by Gist-Brocades, those sold by Genencor International, and those sold under the tradename Opticlean and Optimase by Solvay Enzymes. Protease enzyme may be incorporated into the compositions in accordance with the invention at a level of from 0.0001% to 4% active enzyme by weight of the composition.

Preferred amylases include, for example, α-amylases obtained from a special strain of B licheniformis, described in more detail in GB-1,269,839 (Novo). Preferred commercially available amylases include for example, those sold under the tradename Rapidase by Gist-Brocades, and those sold under the tradename Termamyl, Duramyl and BAN by Novo Industries A/S. Highly preferred amylase enzymes maybe those described in PCT/US9703635, and in WO95/26397 and WO96/23873.

Amylase enzyme may be incorporated into the composition in accordance with the invention at a level of from 0.0001% to 2% active enzyme by weight.

Lipolytic enzyme may be present at levels of active lipolytic enzyme of from 0.0001% to 2% by weight, preferably 0.001% to 1% by weight, most preferably from 0.001% to 0.5% by weight.

The lipase may be fungal or bacterial in origin being obtained, for example, from a lipase producing strain of Humicola sp., Thermomyces sp. or Pseudomonas sp. including *Pseudomonas pseudoalcaligenes* or *Pseudomas fluorescens*. Lipase from chemically or genetically modified mutants of these strains are also useful herein. A preferred lipase is derived from *Pseudomonas pseudoalcaligenes*, which is described in Granted European Patent, EP-B-0218272.

Another preferred lipase herein is obtained by cloning the gene from *Humicola lanuginosa* and expressing the gene in *Asperzillus oryza*, as host, as described in European Patent Application, EP-A-0258 068, which is commercially available from Novo Industri A/S, Bagsvaerd, Denmark, under the trade name Lipolase. This lipase is also described in U.S. Pat. No. 4,810,414, Huge-Jensen et al, issued Mar. 7, 1989.

Optical Brightener

The component or compositions herein also preferably contain from about 0.005% to 5% by weight of certain types of hydrophilic optical brighteners, as mentioned above.

Hydrophilic optical brighteners useful herein include those having the structural formula:

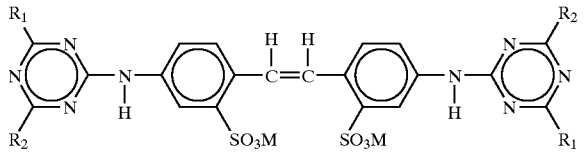

wherein $R_1$ is selected from anilino, N-2-bis-hydroxyethyl and NH-2-hydroxyethyl; $R_2$ is selected from N-2-bis-hydroxyethyl, N-2-hydroxyethyl-N-methylamino, morphilino, chloro and amino; and M is a salt-forming cation such as sodium or potassium.

When in the above formula, $R_1$ is anilino, $R_2$ is N-2-bis-hydroxyethyl and M is a cation such as sodium, the brightener is 4,4',-bis[(4-anilino-6-(N-2-bis-hydroxyethyl)-s-triazine-2-yl)amino]-2,2'-stilbenedisulfonic acid and disodium salt. This particular brightener species is commercially marketed under the tradename Tinopal-UNPA-GX by Ciba-Geigy Corporation. Tinopal-CBS-X and Tinopal-UNPA-GX is the preferred hydrophilic optical brightener useful in the detergent compositions herein.

When in the above formula, $R_1$ is anilino, $R_2$ is N-2-hydroxyethyl-N-2-methylamino and M is a cation such as sodium, the brightener is 4,4'-bis[(4-anilino-6-(N-2-hydroxyethyl-N-methylamino)-s-triazine-2-yl)amino]2,2'-stilbenedisulfonic acid disodium salt. This particular brightener species is commercially marketed under the tradename Tinopal 5BM-GX by Ciba-Geigy Corporation.

When in the above formula, $R_1$ is anilino, $R_2$ is morphilino and M is a cation such as sodium, the brightener is 4,4'-bis[(4-anilino-6-morphilino-s-triazine-2-yl)amino]2,2'-stilbenedisulfonic acid, sodium salt. This particular brightener species are commercially marketed under the tradename Tinopal-DMS-X and Tinopal AMS-GX by Ciba Geigy Corporation.

Photo-Bleaching Agent

Photo-bleaching agents are preferred ingredients of the compositions or components herein. Preferred photo-bleaching agent herein comprise a compounds having a porphin or porphyrin structure.

Porphin and porphyrin, in the literature, are used as synonyms, but conventionally porphin stands for the simplest porphyrin without any substituents; wherein porphyrin is a sub-class of porphin. The references to porphin in this application will include porphyrin.

The porphin structures preferably comprise a metal element or cation, preferably Ca, Mg, P, Ti, Cr, Zr, In, Sn or Hf, more preferably Ge, Si or Ga, or more preferably Al, most preferably Zn.

It can be preferred that the photo-bleaching compound or component is substituted with substituents selected from alkyl groups such as methyl, ethyl, propyl, t-butyl group and aromatic ring systems such as pyridyl, pyridyl-N-oxide, phenyl, naphthyl and anthracyl moieties.

The photo-bleaching compound or component can have solubilizing groups as substituents. Alternatively, or in addition hereto the photo-bleaching agent can comprise a polymeric component capable of solubilizing the photo-bleaching compound, for example PVP, PVNP, PVI or co-polymers thereof or mixtures thereof.

Highly preferred photo-bleaching compounds are compounds having a phthalocyanine structure, which preferably have the metal elements or cations described above.

Metal phthalocyanines and their derivatives have the structure indicated in FIG. 1 and/or FIG. 2, wherein the atom positions of the phthalocyanine structure are numbered conventionally.

The phthalocyanines can be substituted for example the phthalocyanine structures which are substituted at one or more of the 1–4, 6, 8–11, 13, 15–18, 20, 22–25, 27 atom positions.

Water-Soluble Builder Compound

The component or compositions herein preferably contain a water-soluble builder compound, typically present in detergent compositions at a level of from 1% to 80% by weight, preferably from 10% to 60% by weight, most preferably from 15% to 40% by weight.

The detergent compositions of the invention preferably comprise phosphate-containing builder material. Preferably present at a level of from 0.5% to 60%, more preferably from 5% to 50%, more preferably from 8% to 40%.

The phosphate-containing builder material preferably comprises tetrasodium pyrophosphate or even more preferably anhydrous sodium tripolyphosphate.

Suitable water-soluble builder compounds include the water soluble monomeric polycarboxylates, or their acid forms, homo or copolymeric polycarboxylic acids or their salts in which the polycarboxylic acid comprises at least two carboxylic radicals separated from each other by not more that two carbon atoms, borates, and mixtures of any of the foregoing.

The carboxylate or polycarboxylate builder can be momomeric or oligomeric in type although monomeric polycarboxylates are generally preferred for reasons of cost and performance.

Suitable carboxylates containing one carboxy group include the water soluble salts of lactic acid, glycolic acid and ether derivatives thereof. Polycarboxylates containing two carboxy groups include the water-soluble salts of succinic acid, malonic acid, (ethylenedioxy) diacetic acid, maleic acid, diglycolic acid, tartaric acid, tartronic acid and fumaric acid, as well as the ether carboxylates and the sulfinyl carboxylates. Polycarboxylates or their acids containing three carboxy groups include, in particular, water-soluble citrates, aconitrates and citraconates as well as succinate derivatives such as the carboxymethyloxysuccinates described in British Patent No. 1,379,241, lactoxysuccinates described in British Patent No. 1,389,732, and aminosuccinates described in Netherlands Application 7205873, and the oxypolycarboxylate materials such as 2-oxa-1,1,3-propane tricarboxylates described in British Patent No. 1,387,447. The most preferred polycarboxylic acid containing three carboxy groups is citric acid, preferably present at a level of from 0.1% to 15%, more preferably from 0.5% to 8% by weight.

Polycarboxylates containing four carboxy groups include oxydisuccinates disclosed in British Patent No. 1,261,829, 1,1,2,2-ethane tetracarboxylates, 1,1,3,3-propane tetracarboxylates and 1,1,2,3-propane tetracarboxylates. Polycarboxylates containing sulfo substituents include the sulfosuccinate derivatives disclosed in British Patent Nos. 1,398,421 and 1,398,422 and in U.S. Pat. No. 3,936,448, and the sulfonated pyrolysed citrates described in British Patent No. 1,439,000. Preferred polycarboxylates are hydroxycarboxylates containing up to three carboxy groups per molecule, more particularly citrates.

The parent acids of the monomeric or oligomeric polycarboxylate chelating agents or mixtures thereof with their salts, e.g. citric acid or citrate/citric acid mixtures are also contemplated as useful builder components.

Borate builders, as well as builders containing borate-forming materials that can produce borate under detergent storage or wash conditions are useful water-soluble builders herein.

Suitable examples of water-soluble phosphate builders are the alkali metal tripolyphosphates, sodium, potassium and ammonium pyrophosphate, sodium and potassium and ammonium pyrophosphate, sodium and potassium orthophosphate, sodium polymeta/phosphate in which the degree of polymerization ranges from about 6 to 21, and salts of phytic acid.

Partially Soluble or Insoluble Builder Compound

The component in accord with the present invention or the compositions herein may contain a partially soluble or insoluble builder compound, typically present in detergent compositions at a level of from 0.5% to 60% by weight, preferably from 5% to 50% by weight, most preferably from 8% to 40% weight.

Examples of largely water insoluble builders include the sodium aluminosilicates. As mentioned above, it may be preferred in one embodiment of the invention, that only small amounts of alumino silicate builder are present.

Suitable aluminosilicate zeolites have the unit cell formula $Naz[(AlO_2)_z(SiO_2)y]. xH_2O$ wherein z and y are at least 6; the molar ratio of z to y is from 1.0 to 0.5 and x is at least 5, preferably from 7.5 to 276, more preferably from 10 to 264. The aluminosilicate material are in hydrated form and are preferably crystalline, containing from 10% to 28%, more preferably from 18% to 22% water in bound form.

The aluminosilicate zeolites can be naturally occurring materials, but are preferably synthetically derived. Synthetic crystalline aluminosilicate ion exchange materials are available under the designations Zeolite A, Zeolite B, Zeolite P, Zeolite X, Zeolite HS and mixtures thereof. Zeolite A has the formula:

$$Na_{12}[AlO_2)_{12}(SiO_2)_{12}]. xH_2O$$

wherein x is from 20 to 30, especially 27. Zeolite X has the formula $Na_{86}[(AlO_2)_{86}(SiO_2)_{106}]. 276H_2O$.

Another preferred aluminosilicate zeolite is zeolite MAP builder. The zeolite MAP can be present at a level of from 1% to 80%, more preferably from 15% to 40% by weight.

Zeolite MAP is described in EP 384070A (Unilever). It is defined as an alkali metal alumino-silicate of the zeolite P type having a silicon to aluminium ratio not greater than 1.33, preferably within the range from 0.9 to 1.33 and more preferably within the range of from 0.9 to 1.2.

Of particular interest is zeolite MAP having a silicon to aluminium ratio not greater than 1.15 and, more particularly, not greater than 1.07.

In a preferred aspect the zeolite MAP detergent builder has a particle size, expressed as a median particle size $d_{50}$ value of from 1.0 to 10.0 micrometres, more preferably from 2.0 to 7.0 micrometres, most preferably from 2.5 to 5.0 micrometres.

The $d_{50}$ value indicates that 50% by weight of the particles have a diameter smaller than that figure. The particle size may, in particular be determined by conventional analytical techniques such as microscopic determination using a scanning electron microscope or by means of a laser granulometer, described herein. Other methods of establishing $d_{50}$ values are disclosed in EP 384070A.

Organic Polymeric Compound

Organic polymeric compounds are preferred additional herein and are preferably present as components of any particulate components where they may act such as to bind the particulate component together. By organic polymeric compound it is meant herein essentially any polymeric organic compound commonly used as dispersants, and anti-redeposition and soil suspension agents in detergent compositions, including any of the high molecular weight organic polymeric compounds described as clay flocculating agents herein, including quaternised ethoxylated (poly) amine clay-soil removal/anti-redeposition agent in accord with the invention.

Organic polymeric compound is typically incorporated in the detergent compositions of the invention at a level of from 0.01% to 30%, preferably from 0.1% to 15%, most preferably from 0.5% to 10% by weight of the compositions or component.

Examples of organic polymeric compounds include the water soluble organic homo- or co-polymeric polycarboxylic acids or their salts in which the polycarboxylic acid comprises at least two carboxyl radicals separated from each other by not more than two carbon atoms. Polymers of the latter type are disclosed in GB-A-1,596,756. Examples of such salts are polyacrylates of MWt 1000–5000 and their copolymers with maleic anhydride, such copolymers having a molecular weight of from 2000 to 100,000, especially 40,000 to 80,000.

The polyamino compounds are useful herein including those derived from aspartic acid such as those disclosed in EP-A-305282, EP-A-305283 and EP-A-351629.

Terpolymers containing monomer units selected from maleic acid, acrylic acid, polyaspartic acid and vinyl alcohol, particularly those having an average molecular weight of from 5,000 to 10,000, are also suitable herein.

Other organic polymeric compounds suitable for incorporation in the detergent compositions herein include cellulose derivatives such as methylcellulose, carboxymethylcellulose, hydroxypropylmethylcellulose and hydroxyethylcellulose.

Further useful organic polymeric compounds are the polyethylene glycols, particularly those of molecular weight 1000–10000, more particularly 2000 to 8000 and most preferably about 4000.

Highly preferred polymeric components herein are cotton and non-cotton soil release polymer according to U.S. Pat. No. 4,968,451, Scheibel et al., and U.S. Pat. No. 5,415,807, Gosselink et al., and in particular according to U.S. application Ser. No. 60/051517.

Another organic compound, which is a preferred clay dispersant/anti-redeposition agent, for use herein, can be the ethoxylated cationic monoamines and diamines of the formula:

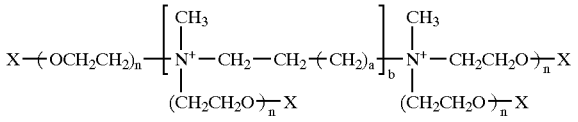

wherein X is a nonionic group selected from the group consisting of H, $C_1$–$C_4$ alkyl or hydroxyalkyl ester or ether groups, and mixtures thereof, a is from 0 to 20, preferably from 0 to 4 (e.g. ethylene, propylene, hexamethylene) b is 1 or 0; for cationic monoamines (b=0), n is at least 16, with a typical range of from 20 to 35; for cationic diamines (b=1), n is at least about 12 with a typical range of from about 12 to about 42.

Other dispersants/anti-redeposition agents for use herein are described in EP-B-011965 and U.S. Pat. No. 4,659,802 and U.S. Pat. No. 4,664,848.

Suds Suppressing System

The components and detergent compositions herein, when formulated for use in machine washing compositions, may comprise a suds suppressing system present at a level of from 0.01% to 15%, preferably from 0.02% to 10%, most preferably from 0.05% to 3% by weight of the composition or component.

Suitable suds suppressing systems for use herein may comprise essentially any known antifoam compound, including, for example silicone antifoam compounds and 2-alkyl alcanol antifoam compounds.

By antifoam compound it is meant herein any compound or mixtures of compounds which act such as to depress the foaming or sudsing produced by a solution of a detergent composition, particularly in the presence of agitation of that solution.

Particularly preferred antifoam compounds for use herein are silicone antifoam compounds defined herein as any antifoam compound including a silicone component. Such silicone antifoam compounds also typically contain a silica component. The term "silicone" as used herein, and in general throughout the industry, encompasses a variety of relatively high molecular weight polymers containing siloxane units and hydrocarbyl group of various types. Preferred silicone antifoam compounds are the siloxanes, particularly the polydimethylsiloxanes having trimethylsilyl end blocking units.

Other suitable antifoam compounds include the monocarboxylic fatty acids and soluble salts thereof. These materials are described in U.S. Pat. No. 2,954,347, issued Sep. 27, 1960 to Wayne St. John. The monocarboxylic fatty acids, and salts thereof, for use as suds suppressor typically have hydrocarbyl chains of 10 to 24 carbon atoms, preferably 12 to 18 carbon atoms. Suitable salts include the alkali metal salts such as sodium, potassium, and lithium salts, and ammonium and alkanolammonium salts.

Other suitable antifoam compounds include, for example, high molecular weight fatty esters (e.g. fatty acid triglycerides), fatty acid esters of monovalent alcohols, aliphatic $C_{18}$–$C_{40}$ ketones (e.g. stearone) N-alkylated amino triazines such as tri- to hexa-alkylmelamines or di- to tetra alkyldiamine chlortriazines formed as products of cyanuric chloride with two or three moles of a primary or secondary amine containing 1 to 24 carbon atoms, propylene oxide, bis stearic acid amide and monostearyl di-alkali metal (e.g. sodium, potassium, lithium) phosphates and phosphate esters.

A preferred suds suppressing system comprises:

(a) antifoam compound, preferably silicone antifoam compound, most preferably a silicone antifoam compound comprising in combination
  (i) polydimethyl siloxane, at a level of from 50% to 99%, preferably 75% to 95% by weight of the silicone antifoam compound; and
  (ii) silica, at a level of from 1% to 50%, preferably 5% to 25% by weight of the silicone/silica antifoam compound;
  wherein said silica/silicone antifoam compound is incorporated at a level of from 5% to 50%, preferably 10% to 40% by weight;

(b) a dispersant compound, most preferably comprising a silicone glycol rake copolymer with a polyoxyalkylene content of 72–78% and an ethylene oxide to propylene oxide ratio of from 1:0.9 to 1:1.1, at a level of from 0.5% to 10%, preferably 1% to 10% by weight; a particularly preferred silicone glycol rake copolymer of this type is DC0544, commercially available from DOW Corning under the tradename DCO544;

(c) an inert carrier fluid compound, most preferably comprising a $C_{16}$–$C_{18}$ ethoxylated alcohol with a degree of ethoxylation of from 5 to 50, preferably 8 to 15, at a level of from 5% to 80%, preferably 10% to 70%, by weight;

A highly preferred particulate suds suppressing system is described in EP-A-0210731 and comprises a silicone antifoam compound and an organic carrier material having a melting point in the range 50° C. to 85° C., wherein the organic carrier material comprises a monoester of glycerol and a fatty acid having a carbon chain containing from 12 to 20 carbon atoms. EP-A-0210721 discloses other preferred particulate suds suppressing systems wherein the organic carrier material is a fatty acid or alcohol having a carbon chain containing from 12 to 20 carbon atoms, or a mixture thereof, with a melting point of from 45° C. to 80° C.

Other highly preferred suds suppressing systems comprise polydimethylsiloxane or mixtures of silicone, such as polydimethylsiloxane, aluminosilicate and polycarboxylic polymers, such as copolymers of laic and acrylic acid.

Polymeric Dye Transfer Inhibiting Agents

The component and/or compositions herein may also comprise from 0.01% to 10%, preferably from 0.05% to 0.5% by weight of polymeric dye transfer inhibiting agents.

The polymeric dye transfer inhibiting agents are preferably selected from polyamine N-oxide polymers, copolymers of N-vinylpyrrolidone and N-vinylimidazole, polyvinylpyrrolidonepolymers or combinations thereof, whereby these polymers can be cross-linked polymers.

Polymeric Soil Release Agent

Polymeric soil release agents, hereinafter "SRA", can optionally be employed in the present components or compositions. If utilized, SRA's will generally comprise from 0.01% to 10.0%, typically from 0.1% to 5%, preferably from 0.2% to 3.0% by weight.

Preferred SRA's typically have hydrophilic segments to hydrophilize the surface of hydrophobic fibers such as polyester and nylon, and hydrophobic segments to deposit upon hydrophobic fibers and remain adhered thereto through completion of washing and rinsing cycles, thereby serving as an anchor for the hydrophilic segments. This can enable stains occurring subsequent to treatment with the SRA to be more easily cleaned in later washing procedures.

Preferred SRA's include oligomeric terephthalate esters, typically prepared by processes involving at least one transesterification/oligomerization, often with a metal catalyst such as a titanium(IV) alkoxide. Such esters may be made using additional monomers capable of being incorporated into the ester structure through one, two, three, four or more positions, without, of course, forming a densely crosslinked overall structure.

Suitable SRA's include a sulfonated product of a substantially linear ester oligomer comprised of an oligomeric ester backbone of terephthatoyl and oxyalkyleneoxy repeat units and allyl-derived sulfonated terminal moieties covalently attached to the backbone, for example as described in U.S. Pat. No. 4,968,451, Nov. 6, 1990 to J. J. Scheibel and E. P. Gosselink. Such ester oligomers can be prepared by: (a) ethoxylating allyl alcohol; (b) reacting the product of (a) with dimethyl terephthalate ("DMT") and 1,2-propylene glycol ("PG") in a two-stage transesterification/oligomerization procedure; and (c) reacting the product of (b) with sodium metabisulfite in water. Other SRA's include the nonionic end-capped 1,2-propylene/polyoxyethylene terephthalate polyesters of U.S. Pat. No. 4,711,730, Dec. 8, 1987 to Gosselink et al., for example those produced by transesterification/oligomerization of poly(ethyleneglycol) methyl ether, DMT, PG and poly(ethyleneglycol) ("PEG"). Other examples of SRA's include: the partly- and fully-anionic-end-capped oligomeric esters of U.S. Pat. No. 4,721,580, Jan. 26, 1988 to Gosselink, such as oligomers from ethylene glycol ("EG"), PG, DMT and Na-3,6-dioxa-8-hydroxyoctanesulfonate; the nonionic-capped block polyester oligomeric compounds of U.S. Pat. No. 4,702,857, Oct. 27, 1987 to Gosselink, for example produced from DMT, methyl (Me)-capped PEG and EG and/or PG, or a combination of DMT, EG and/or PG, Me-capped PEG and Na-dimethyl-5-sulfoisophthalate; and the anionic, especially sulfoaroyl, end-capped terephthalate esters of U.S. Pat. No. 4,877,896, Oct. 31, 1989 to Maldonado, Gosselink et al., the latter being typical of SRA's useful in both laundry and fabric conditioning products, an example being an ester composition made from m-sulfobenzoic acid monosodium salt, PG and DMT, optionally but preferably further comprising added PEG, e.g., PEG 3400.

SRA's also include: simple copolymeric blocks of ethylene terephthalate or propylene terephthalate with polyethylene oxide or polypropylene oxide terephthalate, see U.S. Pat. No. 3,959,230 to Hays, May 25, 1976 and U.S. Pat. No. 3,893,929 to Basadur, Jul. 8, 1975; cellulosic derivatives such as the hydroxyether cellulosic polymers available as METHOCEL from Dow; the $C_1$–$C_4$ alkyl celluloses and $C_4$ hydroxyalkyl celluloses, see U.S. Pat. No. 4,000,093, Dec. 28, 1976 to Nicol, et al.; and the methyl cellulose ethers having an average degree of substitution (methyl) per anhydroglucose unit from about 1.6 to about 2.3 and a solution viscosity of from about 80 to about 120 centipoise measured at 20° C. as a 2% aqueous solution. Such materials are available as METOLOSE SM100 and METOLOSE SM200, which are the trade names of methyl cellulose ethers manufactured by Shin-etsu Kagaku Kogyo KK.

Additional classes of SRA's include: (I) nonionic terephthalates using diisocyanate coupling agents to link polymeric ester structures, see U.S. Pat. No. 4,201,824, Violland et al. and U.S. Pat. No. 4,240,918 Lagasse et al.; and (II) SRA's with carboxylate terminal groups made by adding trimellitic anhydride to known SRA's to convert terminal hydroxyl groups to trimellitate esters. With the proper selection of catalyst, the trimellitic anhydride forms linkages to the terminals of the polymer through an ester of the isolated carboxylic acid of trimellitic anhydride rather than by opening of the anhydride linkage. Either nonionic or anionic SRA's may be used as starting materials as long as they have hydroxyl terminal groups which may be esterified. See U.S. Pat. No. 4,525,524 Tung et al., Other classes include: (III) anionic terephthalate-based SRA's of the urethane-linked variety, see U.S. Pat. No. 4,201,824, Violland et al.

Other Optional Ingredients

Other optional ingredients suitable for inclusion in the compositions of the invention include colours and filler salts, with sodium sulfate being a preferred filler salt.

Highly preferred compositions contain from about 2% to about 10% by weight of an organic acid, preferably citric acid. Also, preferably combined with a carbonate salt, minor amounts (e.g., less than about 20% by weight) of neutralizing agents, buffering agents, phase regulants, hydrotropes, enzyme stabilizing agents, polyacids, suds regulants, opacifiers, anti-oxidants, bactericides and dyes, such as those described in U.S. Pat. No. 4,285,841 to Barrat et al., issued Aug. 25, 1981 (herein incorporated by reference), can be present.

Chlorine-Based Bleach

The detergent compositions can include as an additional component a chlorine-based bleach. However, since the detergent compositions of the invention are solid, most liquid chlorine-based bleaching will not be suitable for these detergent compositions and only granular or powder chlorine-based bleaches will be suitable.

Alternatively, the detergent compositions can be formulated such that they are chlorine-based bleach-compatible, thus ensuring that a chlorine based bleach can be added to the detergent composition by the user at the beginning or during the washing process.

The chlorine-based bleach is such that a hypochlorite species is formed in aqueous solution. The hypochlorite ion is chemically represented by the formula $OCl^-$.

Those bleaching agents which yield a hypochlorite species in aqueous solution include alkali metal and alkaline earth metal hypochlorites, hypochlorite addition products, chloramines, chlorimines, chloramides, and chlorimides. Specific examples of compounds of this type include sodium hypochlorite, potassium hypochlorite, monobasic calcium hypochlorite, dibasic magnesium hypochlorite, chlorinated trisodium phosphate dodecahydrate, potassium dichloroisocyanurate, sodium dichloroisocyanurate sodium dichloroisocyanurate dihydrate, trichlorocyanuric acid, 1,3-dichloro-5,5-dimethylhydantoin, N-chlorosulfamide, Chloramine T, Dichloramine T, chloramine B and Dichloramine B. A preferred bleaching agent for use in the compositions of the instant invention is sodium hypochlorite, potassium hypochlorite, or a mixture thereof. A preferred chlorine-based bleach can be Triclosan (trade name).

Most of the above-described hypochlorite-yielding bleaching agents are available in solid or concentrated form and are dissolved in water during preparation of the compositions of the instant invention. Some of the above materials are available as aqueous solutions.

Laundry Washing Method

Machine laundry methods herein typically comprise treating soiled laundry with an aqueous wash solution in a washing machine having dissolved or dispensed therein an effective amount of a machine laundry detergent composition in accord with the invention. By an effective amount of the detergent composition it is meant from 10 g to 300 g of product dissolved or dispersed in a wash solution of volume from 5 to 65 liters, as are typical product dosages and wash solution volumes commonly employed in conventional machine laundry methods. Preferred washing machines may be the so-called low-fill machines.

In a preferred use aspect the composition is formulated such that it is suitable for hard-surface cleaning or hand washing. In another preferred aspect the detergent composition is a pre-treatment or soaking composition, to be used to pre-treat or soak soiled and stained fabrics.

| Abbreviations used in the effervescence component and detergent composition examples | |
|---|---|
| LAS | Sodium linear C11–13 alkyl benzene sulfonate |
| LAS (I) | Potassium linear or branched C11–13 alkyl benzene sulfonate |
| TAS | Sodium tallow alkyl sulfate |
| CxyAS | Sodium C1x–C1y alkyl sulfate |
| C46SAS | Sodium C14–C16 secondary (2,3) alkyl sulfate |
| CxyEzS | Sodium C1x–C1y alkyl sulfate condensed with z moles of ethylene oxide |
| CxyEz | C1x–C1y predominantly linear primary alcohol condensed with an average of z moles of ethylene oxide |
| QAS | R2.N + (CH3)2(C2H4OH) with R2 = C12–C14 |
| QAS 1 | R2.N + (CH3)2(C2H4OH) with R2 = C8–C11 |
| APA | C8–C10 amido propyl dimethyl amine |
| Soap | Sodium linear alkyl carboxylate derived from an 80/20 mixture of tallow and coconut fatty acids |
| STS | Sodium toluene sulphonate |
| CFAA | C12–C14 (coco) alkyl N-methyl glucamide |
| TFAA | C16–C18 alkyl N-methyl glucamide |
| TPKFA | C12–C14 topped whole cut fatty acids |
| STPP | Anhydrous sodium tripolyphosphate |
| TSPP | Tetrasodium pyrophosphate |
| Zeolite A | Hydrated sodium aluminosilicate of formula Na12(AlO2SiO2)12.27H2O having a primary particle size in the range from 0.1 to 10 micrometers (weight expressed on an anhydrous basis) |
| NaSKS-6 | Crystalline layered silicate of formula d- NaSi2O5 |
| Citric acid I | Anhydrous citric acid, 80% having a particle size of from 40 microns to 70 microns, and having a volume median particle size of 55 microns |
| Citric acid II | Anhydrous or monohydrate citric acid, 80% having a particle size of from 15 microns to 40 microns, having a volume average particle size of 25 microns |
| Malic acid | Anhydrous malic acid, 80% having a particle size of from 50 microns to 100 microns, having a volume median particle size of 75 microns |
| Maleic acid | Anhydrous maleic acid, 80% having a particle size of from 5 microns to 30 microns, having a volume median particle size of 15 microns |
| Tartaric acid | Anhydrous tartaric acid, 80% having a particle size of from 25 microns to 75 microns, having a volume median particle size of 50 microns |
| Carbonate I | Anydrous sodium carbonate having 80% by volume of particles with a particle size from 50 microns to 150 microns with a volume median particle size of 100 microns |
| Carbonate II | Anydrous sodium carbonate having 80% by volume of particles with a particle size from 35 microns to 75 microns, having a volume median particle size of 55 microns |
| Bicarbonate II | Anhydrous sodium bicarbonate having 80% by volume of particles with a particle size from 100 microns to 200 microns with a volume median particle size of 150 microns |
| Bicarbonate I | Anydrous sodium bicarbonate having 80% by volume of particles with a particle size from 15 microns to 40 microns, having a volume median particle size of 25 microns |
| Silicate | Amorphous sodium silicate (SiO2:Na2O = 2.0:1) |
| Sulfate | Anhydrous sodium sulfate |
| Mg sulfate | Anhydrous magnesium sulfate |
| Citrate | Tri-sodium citrate dihydrate of activity 86.4% with a particle size distribution between 425 $\mu$m and 850 $\mu$m |
| MA/AA | Copolymer of 1:4 maleic/acrylic acid, average molecular weight about 70,000 |
| MA/AA (1) | Copolymer of 4:6 maleic/acrylic acid, average molecular weight about 10,000 |
| AA | Sodium polyacrylate polymer of average molecular weight 4,500 |
| CMC | Sodium carboxymethyl cellulose |
| Cellulose ether | Methyl cellulose ether with a degree of polymerization of 650 available from Shin Etsu Chemicals |
| Protease | Proteolytic enzyme, having 3.3% by weight of active enzyme, sold by NOVO Industries A/S under the tradename Savinase |
| Protease I | Proteolytic enzyme, having 4% by weight of active enzyme, as described in WO 95/10591, sold by Genencor Int. Inc. |
| Alcalase | Proteolytic enzyme, having 5.3% by weight of active enzyme, sold by NOVO Industries A/S |
| Cellulase | Cellulytic enzyme, having 0.23% by weight of active enzyme, sold by NOVO Industries A/S under the tradename Carezyme |
| Amylase | Amylolytic enzyme, having 1.6% by weight of active enzyme, sold by NOVO Industries A/S under the tradename Termamyl 120T |
| Lipase | Lipolytic enzyme, having 2.0% by weight of active enzyme, sold by NOVO Industries A/S under the tradename Lipolase |

-continued

| Abbreviations used in the effervescence component and detergent composition examples | |
|---|---|
| Lipase (1) | Lipolytic enzyme, having 2.0% by weight of active enzyme, sold by NOVO Industries A/S under the tradename Lipolase Ultra |
| Endolase | Endoglucanase enzyme, having 1.5% by weight of active enzyme, sold by NOVO Industries A/S |
| PB4 | Particle containing sodium perborate tetrahydrate of nominal formula NaBO2.3H2 O, the particles having a weight average particle size of 950 microns, 85% particles having a particle size of from 850 microns to 950 microns |
| PB1 | Particle containing anhydrous sodium perborate bleach of nominal formula NaBO2.H 2O2, the particles having a weight average particle size of 800 microns, 85% particles having a particle size of from 750 microns to 950 microns |
| Percarbonate | Particle containing sodium percarbonate of nominal formula 2NaCO3.3H2O2, the particles having a weight average particle size of 850 microns, 5% or less having a particle size of less than 600 microns and 2% or less having a particle size of more than 1180 microns |
| NOBS | Particle comprising nonanoyloxybenzene sulfonate in the form of the sodium salt, the particles having a weight average particle size of 750 microns to 900 microns |
| NAC-OBS | Particle comprising (6-nonamidocaproyl) oxybenzene sulfonate, the particles having a weight average particle size of from 825 microns to 875 microns |
| TAED I | Particle containing tetraacetylethylenediamine, the particles having a weight average particle size of from 700 microns to 1000 microns |
| TAED II | Tetraacetylethylenediamine of a particle size from 150 microns to 600 microns |
| DTPA | Diethylene triamine pentaacetic acid |
| DTPMP | Diethyiene triamine penta (methylene phosphonate), marketed by Monsanto under the Tradename Dequest 2060 |
| Photoactivated | Sulfonated zinc phthlocyanine encapsulated in bleach (1) dextrin soluble polymer |
| Photoactivated | Sulfonated alumino phthlocyanine encapsulated in bleach (2) dextrin soluble polymer |
| Brightener 1 | Disodium 4,4'-bis(2-sulphostyryl)biphenyl |
| Brightener 2 | Disodium 4,4'-bis(4-anilino-6-morpholino-1.3.5-triazin-2-yl)amino) stilbene-2:2'-disulfonate |
| EDDS | Ethylenediamine-N,N'-disuccinic acid, (S,S) isomer in the form of its sodium salt. |
| HEDP | 1,1-hydroxyethane diphosphonic acid |
| PEGx | Polyethylene glycol, with a molecular weight of x (typically 4,000) |
| PEO | Polyethylene oxide, with an average molecular weight of 50,000 |
| TEPAE | Tetraethylenepentaamine ethoxylate |
| PVI | Polyvinyl imidosole, with an average molecular weight of 20,000 |
| PVP | Polyvinylpyrolidone polymer, with an average molecular weight of 60,000 |
| PVNO | Polyvinylpyridine N-oxide polymer, with an average molecular weight of 50,000 |
| PVPVI | Copolymer of polyvinylpyrolidone and vinylimidazole, with an average molecular weight of 20,000 |
| QEA | bis((C2H5O)(C2H4O)n)(CH3)—N + —C6H12—N + —(CH3) bis((C2H5O)—(C2H4 O))n, wherein n = from 20 to 30 |
| SRP 1 | Anionically end capped poly esters |
| SRP 2 | Diethoxylated poly (1,2 propylene terephtalate) short block polymer |
| PEI | Polyethyleneimine with an average molecular weight of 1800 and an average ethoxylation degree of 7 ethyleneoxy residues per nitrogen |
| Silicone antifoam | Polydimethylsiloxane foam controller with siloxane-oxyalkylene copolymer as dispersing agent with a ratio of said foam controller to said dispersing agent of 10:1 to 100:1 |
| Opacifier | Water based monostyrene latex mixture, sold by BASF Aktiengesellschaft under the tradename Lytron 621 |
| Wax | Paraffin wax |

Effervescence granule: any of the effervescence granules I to XII

The following effervescence granules I to XII are in accord with the invention (ingredients in % by weight of effervescence granule). The granules can be prepared by mixing the ingredients and agglomerating the ingredients or by compacting the mixed ingredients, the later being the preffered process for preparing particle I, IV and VIII.

| PARTICLES | I | II | III | IV | V | VI | VII | VIII | IX | X | XI | XII |
|---|---|---|---|---|---|---|---|---|---|---|---|---|
| Citric acid I | 60 | | 35 | | | 20 | | | | 20 | | |
| Citric acid II | | 40 | | | | | | 20 | 30 | | | 30 |
| Malic acid I | | | | 50 | | 20 | | | | | 40 | |
| Malic acid II | | | | | 30 | | | | | | | |

-continued

| PARTICLES | I | II | III | IV | V | VI | VII | VIII | IX | X | XI | XII |
|---|---|---|---|---|---|---|---|---|---|---|---|---|
| Tarteric acid | | | | | | | 50 | | | | | |
| Maleic acid | | | | | | | | 30 | | | | |
| Carbonate I | 40 | | | 20 | | 40 | | | 30 | 30 | 20 | |
| Carbonate II | | 20 | 30 | | 30 | | 35 | 30 | | | | 20 |
| Bicarbonate I | | 20 | | | | | | | | | | |
| Bicarbonate II | | | | 30 | | | | 20 | | | 20 | |
| LAS | | 10 | | | 20 | | | | 20 | | | |
| Nonionic* | | | | | | | | | | 30 | 20 | 30 |
| AS | | | | | | 10 | | | | 20 | | |
| TAED | | | 20 | | | | | | | | | 5 |
| Desiccant# | | | 2 | | | | 5 | | | | | 10 |
| NACOBS | | | | | 20 | | | | | | | |
| NOBS | | | | | | | | | 20 | | | |
| CMC | | | 5 | | | | | | | | | 5 |
| Percarbonate | | | | | | | 10 | | | | | |

-continued

| PARTICLES | I | II | III | IV | V | VI | VII | VIII | IX | X | XI | XII |
|---|---|---|---|---|---|---|---|---|---|---|---|---|
| Brightner | | | 3 | | | | | | | | | |
| PEG 4000 | | 10 | 5 | | | 10 | | | | | | |

#(overdried or anhydrous salts/zeolite or overdried zeolite
*nonionic ethoxylated alcohol surfactant having an average ethoxylation degree of from 3 to 9, having an alcohol alkyl chain of 12 to 18 carbon atoms

EXAMPLE 1

In the following examples all levels are quoted as % by weight of the composition:

TABLE I

The following compositions are in accordance with the invention.

| | A | B | C | D | E | F | G | H | I |
|---|---|---|---|---|---|---|---|---|---|
| Spray-dried Granules | | | | | | | | | |
| LAS | 10.0 | 10.0 | 15.0 | 5.0 | 5.0 | 10.0 | — | — | — |
| TAS | — | 1.0 | — | | | | — | — | — |
| MBAS | — | — | | 5.0 | 5.0 | | — | — | — |
| $C_{45}AS$ | — | — | 1.0 | | 2.0 | 2.0 | — | — | — |
| $C_{45}AE_3S$ | — | — | | 1.0 | | | — | — | — |
| QAS | | | 1.0 | 1.0 | | | — | — | — |
| DTPA, HEDP and/or EDDS | 0.3 | 0.3 | 0.5 | 0.3 | | | — | — | — |
| MgSO4 | 0.5 | 0.5 | 0.1 | — | | | — | — | — |
| Sodium citrate | — | — | — | 3.0 | 5.0 | | — | — | — |
| Sodium carbonate | 10.0 | 7.0 | 15.0 | | | 10.0 | — | — | — |
| Sodium sulphate | 5.0 | 5.0 | — | — | 5.0 | 3.0 | — | — | — |
| Sodium silicate 1.6R | — | — | — | — | 2.0 | | — | — | — |
| Zeolite A | 16.0 | 18.0 | 20.0 | 20.0 | — | — | — | — | — |
| SKS-6 | — | — | — | 3.0 | 5.0 | — | — | — | — |
| MA/AA or AA | 1.0 | 2.0 | 11.0 | — | — | 2.0 | — | — | — |
| PEG 4000 | — | 2.0 | — | 1.0 | — | 1.0 | — | — | — |
| QEA | 1.0 | — | — | — | 1.0 | — | — | — | — |
| Brightener | 0.05 | 0.05 | 0.05 | — | 0.05 | — | — | — | — |
| Silicone oil | 0.01 | 0.01 | 0.01 | — | — | 0.01 | — | — | — |
| effervescence granule I, III, IV or VIII | 10 | 7.0 | — | — | — | — | — | — | — |
| Agglomerate | | | | | | | | | |
| LAS | | | — | — | — | — | 2.0 | 2.0 | — |
| MBAS | | | — | — | — | — | — | — | 1.0 |
| $C_{45}AS$ | | | — | — | — | — | 2.0 | — | — |
| $AE_3$ | | | — | — | — | — | — | 1.0 | 0.5 |
| Carbonate | | | — | — | 4.0 | 1.0 | 1.0 | 1.0 | — |
| Sodium citrate | | | — | — | — | — | — | — | 5.0 |
| CFAA | | | | | — | — | — | — | — |
| Citric acid | | | — | — | — | 4.0 | — | 1.0 | 1.0 |
| QEA | | | — | — | — | 2.0 | 2.0 | 1.0 | — |
| SRP | | | — | — | — | 1.0 | 1.0 | 0.2 | — |
| Zeolite A | | | — | — | — | 15.0 | 26.0 | 15.0 | 16.0 |
| Sodium silicate | | | — | — | — | — | — | — | — |
| PEG | — | — | — | — | — | — | 4.0 | — | — |
| Builder Agglomerates | | | | | | | | | |
| SKS-6 | 6.0 | — | — | — | 6.0 | 3.0 | — | 7.0 | 10.0 |
| LAS | 4.0 | 5.0 | — | — | 5.0 | 3.0 | — | 10.0 | 12.0 |
| Dry-add particulate components | | | | | | | | | |
| effervescence granule | — | 4.0 | 10.0 | 4.0 | 25 | 8.0 | 12.0 | 2.0 | 4.0 |
| QEA | — | — | — | 0.2 | 0.5 | — | — | — | — |
| NACAOBS | 3.0 | — | — | 4.5 | — | — | — | 2.5 | — |
| NOBS | 1.0 | 3.0 | 3.0 | — | — | — | — | — | 5.0 |
| TAED I | 2.5 | — | — | 1.5 | 2.5 | 6.5 | — | 1.5 | — |

TABLE I-continued

The following compositions are in accordance with the invention.

| | A | B | C | D | E | F | G | H | I |
|---|---|---|---|---|---|---|---|---|---|
| MBAS | — | — | — | 8.0 | — | — | 8.0 | — | 4.0 |
| LAS (flake) | 10.0 | 10.0 | — | — | — | — | — | 8.0 | — |
| Citric acid II | — | — | — | | | | | | |
| Spray-on | | | | | | | | | |
| Brightener | 0.2 | 0.2 | 0.3 | 0.1 | 0.2 | 0.1 | — | 0.6 | 0.3 |
| Dye | — | — | — | 0.3 | 0.05 | 0.1 | — | — | — |
| AE7 | — | — | — | — | — | 0.5 | — | 0.7 | — |
| Perfume | 1.0 | 0.5 | 1.1 | 0.8 | 0.3 | 0.5 | 0.3 | 0.5 | — |
| Dry-add | | | | | | | | | |
| Citrate | — | — | 20.0 | 4.0 | — | 5.0 | 15.0 | — | 5.0 |
| Percarbonate | 15.0 | 3.0 | 6.0 | 10.0 | — | — | 24.0 | 18.0 | 5.0 |
| Perborate | — | — | — | — | 6.0 | 18.0 | — | — | — |
| Photobleach | 0.02 | 0.02 | 0.02 | 0.1 | 0.05 | — | 0.3 | — | 0.03 |
| Enzymes (cellulase, amylase, protease, lipase) | 1.3 | 0.3 | 0.5 | 0.5 | 0.8 | 2.0 | 0.5 | 0.16 | 0.2 |
| Carbonate | 0.0 | 10.0 | — | — | — | 5.0 | 8.0 | 10.0 | 5.0 |
| Perfume (encapsulated) | — | 0.5 | 0.5 | — | 0.3 | — | 0.2 | — | — |
| Suds suppressor | 1.0 | 0.6 | 0.3 | — | 0.10 | 0.5 | 1.0 | 0.3 | 1.2 |
| Soap | 0.5 | 0.2 | 0.3 | 3.0 | 0.5 | — | — | 0.3 | — |
| Citric acid (I or coarse) | — | — | — | 6.0 | 6.0 | — | — | — | 5.0 |
| Dyed carbonate (blue, green) | 0.5 | 0.5 | 1.0 | 2.0 | — | 0.5 | 0.5 | 0.5 | 1.0 |
| SKS-6 | — | — | — | 4.0 | — | — | — | 6.0 | — |
| Fillers up to 100% | | | | | | | | | |

TABLE II

The following compositions are in accordance with the invention.

| | A | B | C | D | E | F | G | H | I |
|---|---|---|---|---|---|---|---|---|---|
| Spray-Dried Granules | | | | | | | | | |
| LAS or LAS (I) | 10.0 | 10.0 | 16.0 | 5.0 | 5.0 | 10.0 | — | — | — |
| TAS | — | 1.0 | — | | | | — | — | — |
| MBAS | — | — | — | 5.0 | 5.0 | | — | — | — |
| $C_{45}AS$ | — | — | 1.0 | | 2.0 | 2.0 | — | — | — |
| $C_{45}AE_3S$ | — | — | — | 1.0 | | | — | — | — |
| QAS | — | — | 1.0 | 1.0 | | | — | — | — |
| DTPA, HEDP and/or EDDS | 0.3 | 0.3 | 0.3 | 0.3 | | | — | — | — |
| MgSO4 | 0.5 | 0.4 | 0.1 | — | | | — | — | — |
| Sodium citrate | 10.0 | 12.0 | 17.0 | 3.0 | 5.0 | | — | — | — |
| Sodium carbonate | 15.0 | 8.0 | 15.0 | | | 10.0 | — | — | — |
| Sodium sulphate | 5.0 | 5.0 | — | — | 5.0 | 3.0 | — | — | — |
| Sodium silicate 1.6R | — | — | — | — | 2.0 | | — | — | — |
| Zeolite A | — | — | — | 2.0 | — | — | — | — | — |
| SKS-6 | — | — | — | 3.0 | 5.0 | — | — | — | — |
| MA/AA or AA | 1.0 | 2.0 | 10.0 | — | — | 2.0 | — | — | — |
| PEG 4000 | — | 2.0 | — | 1.0 | — | 1.0 | — | — | — |
| QEA | 1.0 | — | — | — | 1.0 | — | — | — | — |
| Brightener | 0.05 | 0.05 | 0.05 | — | 0.05 | — | — | — | — |
| Silicone oil | 0.01 | 0.01 | 0.01 | — | — | 0.01 | — | — | — |
| Effervescence granule I, III, IV VII or VIII | 5 | 12 | — | — | — | — | — | — | — |
| Agglomerate | | | | | | | | | |
| LAS | — | — | — | — | — | — | 2.0 | 2.0 | — |
| MBAS | — | — | — | — | — | — | — | — | 1.0 |
| $C_{45}AS$ | — | — | — | — | — | — | 2.0 | — | — |
| $AE_3$ | — | — | — | — | — | — | — | 1.0 | 0.5 |
| Carbonate | — | — | — | — | 4.0 | 1.0 | 1.0 | 1.0 | — |
| Sodium citrate | — | — | — | — | — | — | — | — | 5.0 |
| CFAA | — | — | — | | — | — | — | — | — |
| Citric acid | — | — | — | — | — | 4.0 | — | 1.0 | 1.0 |
| QEA | — | — | — | — | — | 2.0 | 2.0 | 1.0 | — |
| SRP | — | — | — | — | — | 1.0 | 1.0 | 0.2 | — |
| Zeolite A | — | — | — | — | — | 15.0 | 26.0 | 15.0 | 16.0 |
| Sodium silicate | — | — | — | — | — | — | — | — | — |
| PEG | — | — | — | — | — | — | 4.0 | — | — |
| TAED II | | | | | | | 3.0 | | 1.5 |

TABLE II-continued

The following compositions are in accordance with the invention.

| | A | B | C | D | E | F | G | H | I |
|---|---|---|---|---|---|---|---|---|---|
| Builder Agglomerate | | | | | | | | | |
| SKS-6 | 6.0 | 5.0 | — | — | 6.0 | 3.0 | — | 7.0 | 10.0 |
| LAS | 4.0 | 5.0 | — | — | 5.0 | 3.0 | — | 10.0 | 12.0 |
| Dry-add particulate components | | | | | | | | | |
| Effervescence granule | — | 10.0 | 4.0 | 5 | 15 | 8.0 | 2.0 | 20 | 4.0 |
| NACAOBS | 3.0 | — | — | 1.5 | — | — | — | 5.5 | — |
| NOBS/LOBS/DOBS | — | 3.0 | 3.0 | — | — | — | — | — | 5.0 |
| TAED I | 2.5 | — | — | 1.5 | 2.5 | 6.5 | — | 1.5 | — |
| MBAS | — | — | — | 8.0 | — | — | 8.0 | — | 4.0 |
| LAS (flake) | — | — | — | — | — | — | — | 8.0 | — |
| Spray-on | | | | | | | | | |
| Brightener | 0.2 | 0.2 | 0.3 | 0.1 | 0.2 | 0.1 | — | 0.6 | — |
| Dye | — | — | — | 0.3 | 0.05 | 0.1 | — | — | — |
| AE7 | — | — | — | — | — | 0.5 | — | 0.7 | — |
| Perfume | — | — | — | 0.8 | — | 0.5 | 0.8 | 0.5 | 1.0 |
| Dry-add | | | | | | | | | |
| QEA | — | — | — | 0.2 | 0.5 | — | — | — | — |
| Citrate | 4.0 | — | 3.0 | 4.0 | — | 5.0 | 15.0 | — | 5.0 |
| Percarbonate | 15.0 | 3.0 | 6.0 | 10.0 | — | — | 12.0 | 18.0 | 5.0 |
| Perborate | — | — | — | — | 6.0 | 18.0 | — | — | — |
| Photobleach | 0.02 | 0.02 | 0.02 | 0.1 | 0.05 | — | 0.3 | — | 0.03 |
| Enzymes (cellulase, amylase, protease, lipase) | 1.5 | 0.3 | 0.5 | 0.5 | 0.8 | 2.0 | 0.5 | 0.16 | 0.2 |
| Carbonate II | — | — | — | — | — | 5.0 | 8.0 | 10.0 | 5.0 |
| Perfume (encapsulated) | 0.6 | 0.5 | 0.5 | — | 0.3 | 0.5 | 0.2 | 0.1 | 0.6 |
| Suds suppressor | 1.0 | 0.6 | 0.3 | — | 0.10 | 0.5 | 1.0 | 0.3 | 1.2 |
| Soap | 0.5 | 0.2 | 0.3 | 3.0 | 0.5 | — | — | 0.3 | — |
| Citric acid II | — | — | — | — | — | — | — | 5.0 | 5.0 |
| Dyed carbonate (blue, green) | 0.5 | 0.5 | ? | 2.0 | — | 0.5 | 0.5 | 0.5 | 1.0 |
| SKS-6 | — | — | — | 4.0 | — | — | — | 6.0 | — |
| Fillers up to 100% | | | | | | | | | |

TABLE III

The following are high density and bleach-containing detergent formulations according to the present invention:

| | A | B | C |
|---|---|---|---|
| Blown Powder | | | |
| Zeolite A | — | — | 15.0 |
| Sodium sulfate | 0.0 | 5.0 | 0.0 |
| LAS | 3.0 | — | 3.0 |
| C45AS | 3.0 | 2.0 | 4.0 |
| QAS | — | — | 1.5 |
| DTPMP | 0.4 | 0.4 | 0.4 |
| CMC | 0.4 | 0.4 | 0.4 |
| MA/AA | 4.0 | 2.0 | 2.0 |
| effervescence granule I or VIII | 7.0 | — | — |
| TAED | — | — | 3.0 |
| Agglomerates | | | |
| effervescence granule I, III, VIII or IX | 7.0 | — | 7.0 |
| QAS | 1.0 | — | — |
| LAS | — | 11.0 | 7.0 |
| TAS | 2.0 | 2.0 | 1.0 |
| Silicate | 3.0 | — | 4.0 |
| Zeolite A | 8.0 | 8.0 | 8.0 |
| Carbonate | 8.0 | 8.0 | 4.0 |
| Agglomerate | | | |
| NaSKS-6 (I) or (II) | 15.0 | 12.0 | 5.0 |
| LAS | 8.0 | 7.0 | 4.0 |
| AS | 5.0 | — | — |

TABLE III-continued

The following are high density and bleach-containing detergent formulations according to the present invention:

| | A | B | C |
|---|---|---|---|
| Spray On | | | |
| Perfume | 0.3 | 0.3 | 0.3 |
| C25E3 | 2.0 | — | 2.0 |
| brightener | 0.1 | 0.4 | |
| photobleach | 0.03 | 0.05 | — |
| Dry additives | | | |
| QEA | 1.0 | 0.5 | 0.5 |
| Citric acid I | 5.0 | — | 2.0 |
| Bicarbonate I | — | 3.0 | — |
| Carbonate II | 8.0 | 15.0 | 10.0 |
| NAC OBS | 6.0 | — | 5.0 |
| Manganese catalyst | — | — | 0.3 |
| TAED I | | 3.0 | — |
| NOBS | — | 2.0 | — |
| Percarbonate | 14.0 | 7.0 | 10.0 |
| Polyethylene oxide of MW 5,000,000 | — | — | 0.2 |
| Bentonite clay | — | — | 10.0 |
| effervescnece granule | — | 5.5 | 7.5 |
| Protease | 1.0 | 1.0 | 1.0 |
| Lipase | 0.4 | 0.4 | 0.4 |
| Amylase | 0.6 | 0.6 | 0.6 |
| Cellulase | 0.6 | 0.6 | 0.6 |
| Silicone antifoam | 5.0 | 5.0 | 5.0 |

TABLE III-continued

| The following are high density and bleach-containing detergent formulations according to the present invention: | | | |
|---|---|---|---|
| | A | B | C |
| Dry additives | | | |
| Sodium sulfate | 0.0 | 3.0 | 0.0 |
| Balance (Moisture and Miscellaneous) | 100.0 | 100.0 | 100.0 |
| Density (g/litre) | 850 | 850 | 850 |

EXAMPLE 2

Coating the Effervescence Component

Tallow alcohol ethylene oxide condensate (TAE) of type tallow alcohol condensed with 50 to 80 moles of ethylene oxide (TAE 50/80) is melted at 70° C. 4.750 kg of effervescence component (compacted 64% citric acid with 36% sodium carbonate) is placed into a rotating drum mixer (Eirich) and the mixer is turned on but not set to rotate. This is to encourage slow mixing of the "fizz particles". 250 g melted TAE 50/80 is placed in a heated vessel (outer water jacket ~80° C.) attached to a Devilbliss spraygun with atomising air at 80° C. This is to give 5% of total weight TAE 50/80. The drum mixer is turned on to rotate and the melted TAE 50/80 is sprayed onto the moving effervescence components in such a manner as to adhere onto the surface of the effervescence components, effectively coating the effervescence components. Once all of the melted TAE 50/80 has been sprayed onto the effervescence components, the drum mixer is left to rotate until the TAE 50/80 has hardened on the surface of the effervescence components (i.e. until it has solidified). The TAE 50/80 coated effervescence components are then screened at 1180 micrometers to remove any agglomerated particles. This is particle XIII in regard to the examples.

What is claimed is:

1. A process for manufacturing an effervescence component comprising an acid source and a carbon dioxide source for a detergent composition wherein said process comprises the steps of:

grinding a coarse acid source to obtain an acid source whereof at least 75% has a particle size from 0.1 to 150 microns prior to mixing with the carbon dioxide source, mixing said ground acid source and the carbon dioxide source and a binder and other optional actives to form a mixture, and submitting the mixture to a granulation step, wherein said acid source is selected from the group consisting of sulphonic acids, mono or polycarboxylic acids and mixtures thereof;

wherein the carbon dioxide source is selected from the group consisting of sodium carbonate, sodium bicarbonate, and mixtures thereof and wherein said granulation step comprises a roller compaction step wherein the resulting mixture is forced between compaction rolls under pressure, whereafter the compacted mixture obtained is granulated into effervescent granules and optionally sieved.

* * * * *